US006639559B2

(12) United States Patent
Okabe et al.

(10) Patent No.: US 6,639,559 B2
(45) Date of Patent: Oct. 28, 2003

(54) ANTENNA ELEMENT

(75) Inventors: Hiroshi Okabe, Kokubunji (JP); Eriko Takeda, Tokyo (JP); Hiroyuki Aoyama, Kumagaya (JP); Keiko Kikuchi, Ageo (JP)

(73) Assignees: Hitachi Ltd., Tokyo (JP); Hitachi Metals Ltd., Tokyo (JP)

( * ) Notice: Subject to any disclaimer, the term of this patent is extended or adjusted under 35 U.S.C. 154(b) by 0 days.

(21) Appl. No.: 10/082,092

(22) Filed: Feb. 26, 2002

(65) Prior Publication Data

US 2002/0126049 A1 Sep. 12, 2002

(30) Foreign Application Priority Data

Mar. 7, 2001 (JP) ..... 2001-063168
Sep. 27, 2001 (JP) ..... 2001-295743

(51) Int. Cl.[7] ..... H01Q 1/38
(52) U.S. Cl. ..... 343/700 MS; 343/702
(58) Field of Search ..... 343/700 MS, 702, 343/873, 895, 846, 848, 795

(56) References Cited

U.S. PATENT DOCUMENTS 5,517,676 A 5/1996 Sekine et al. ..... 455/89
5,903,822 A 5/1999 Sekine et al. ..... 455/89
6,329,962 B2 * 12/2001 Ying ..... 343/895
6,417,816 B2 * 7/2002 Sadler et al. ..... 343/795
6,452,548 B2 * 9/2002 Nagumo et al. ..... 343/700 MS

* cited by examiner

*Primary Examiner*—James Clinger
(74) *Attorney, Agent, or Firm*—Sughrue Mion, PLLC

(57) ABSTRACT

To provide an antenna element having a radiation electrode formed mainly on one surface of a dielectric substrate. The radiation electrode is substantially symmetric in form with respect to the center thereof, and has a first half and a second half with the same direction of main polarization of radiation emitted therefrom. Each of the halves of the radiation electrode may be a quarter-wave antenna for a wavelength of the emitted radiation. A power supply conductor to be connected to a high frequency signal source is connected to the first half of the radiation electrode, and a ground conductor to be connected to a ground is connected to the second half. A total impedance of the first half of the radiation electrode and the power supply conductor and a total impedance of the second half of the radiation electrode and the ground conductor can substantially match to one another, so that resonance between the halves of the radiation electrode can be enhanced and a wider bandwidth can be realized.

25 Claims, 15 Drawing Sheets

ANTENNA ELEMENT

CROSS-REFERENCE TO RELATED APPLICATIONS

This application claims convention priority based on Japanese Patent Applications No. 2001-63168 filed on Mar. 7, 2001, and 2001-295743 filed on Sep. 27, 2001. These Japanese patent Applications are incorporated by reference in this application.

BACKGROUND OF THE INVENTION

1. Field of the Invention

The present invention relates to a small antenna element suitable for use in a mobile telecommunication device, in particular, to a surface-mounted antenna element.

2. Description of the Related Art

An antenna element used in a mobile telecommunication device may often be a linear antenna element, in particular, a half-wave antenna element having a length one-half a wavelength for a used frequency to produce resonance. However, for miniaturization of antennas, a monopole antenna consisting of a quarter-wave radiation electrode has come into use.

While the quarter-wave monopole antenna can be miniaturized easier than the half-wave antenna because of its shorter radiation electrode, it has a problem in that a radiation characteristic thereof is disturbed by an induced current occurring in a board-grounding conductor or housing for electromagnetically shielding a circuit of the telecommunication device. To solve this problem, in U.S. Pat. No. 5,517,676 issued May 14, 1996 and U.S. Pat. No. 5,903,822 issued May 11, 1999, there has been proposed a technique of using a quarter-wave monopole antenna and canceling the effect of the induced current flowing through a housing by forming a recess in the housing at a position distant from an antenna feeding point by a quarter of a wavelength for a used frequency. Besides, a technique of canceling the effect of the induced current by providing a stub having a length of a quarter of the wavelength has been proposed. However, these techniques contradict miniaturization. On the contrary, the half-wave antenna element has the advantage of being less affected by the board-grounding surface. However, since the half-wave antenna requires the radiation electrode longer than that of the quarter-wave antenna, it is not suitable for miniaturization, and therefore has typically been used as the monopole antenna pulled out of the telecommunication device.

Furthermore, a chip antenna, which is a small chip, having a radiation electrode formed on a dielectric substrate has the advantage that the antenna element can be miniaturized and the substrate can be mounted on a printed wiring board. However, it has the disadvantage that an available frequency bandwidth is narrow.

SUMMARY OF THE INVENTION

Thus, an object of the present invention is to provide a small antenna element with a stable characteristic that can be enhanced in radiation efficiency and bandwidth thereof.

Another object of the present invention is to provide a telecommunication device having the antenna element mounted thereon, for example, a telecommunication device mounted on a cellular phone, a headphone, a personal computer, a notebook PC, a digital camera or the like as an antenna for Bluetooth.

Another object of the present invention is to provide an antenna element having a radiation electrode of a shape symmetric with respect to the center thereof, both the halves of the radiation electrode being matched in impedance, and capable of producing enhanced resonance in the antenna portion, and a telecommunication device having the antenna element.

An antenna element according to the present invention comprises a dielectric substrate, and a radiation electrode of an electric conductor formed mainly on a surface of the dielectric substrate. The dielectric substrate is a dielectric chip, preferably a hexahedron of dielectric material. The antenna element has a power supply conductor and a ground conductor, which are connected to the radiation electrode, on the dielectric substrate, preferably on a surface other than the surface of the dielectric substrate on which the radiation electrode is formed. The radiation electrode has first and second halves, the first and the second halves being substantially symmetric in form to one another with respect to the center of the radiation electrode and being to radiate with the same direction of main polarization of radiation emitted from the radiation electrode. The first half has a first open end at its outer end and a first connection terminal adjacent to the center. The second half has a second open end at its outer end and a second connection terminal adjacent to the center, the second connection terminal being at a distance from the first connection terminal on the radiation electrode. A power supply conductor is formed on the dielectric substrate and connected to the first connection terminal at one end thereof and has at the other end a terminal for connecting to a high frequency signal source. A ground conductor is formed on the dielectric substrate and connected to the second connection terminal at one end thereof and has at the other end a terminal for connecting to a ground.

A portion of the first half between the first open end and the first connection terminal is asymmetric in form to a portion of the second half between the second open end and the second connection terminal. Alternatively, the power supply conductor is asymmetric in form to the ground conductor. Due to this asymmetric form, the total impedance of the power supply conductor and the portion of the first half between the first open end of the first half and the terminal of the power supply conductor at the other end for connecting to a high frequency signal source and the internal impedance of the high frequency signal source can substantially match, in total impedance, the ground conductor and the portion of the second half between the second open end of the second half and the terminal of the ground conductor at the other end for connecting to a ground.

In the antenna element according to this invention, it is preferred that the first and the second halves of the radiation electrode connect capacitively to a ground at the first and at the second open ends, respectively. Further preferably, the antenna element further comprises ground electrodes, formed adjacent to the first and the second open ends on the dielectric substrate, for connecting a ground, each of the ground electrodes connecting capacitively to the first and the second halves of the radiation electrode at the first and at the second open ends, respectively.

The radiation electrode of the antenna element according to this invention is preferably in a meandering form. Since the meandering form allows the radiation electrode to be mounted on a small surface of the dielectric substrate even if the radiation electrode is long, the size of the antenna element can be reduced.

The electric conductor forming the radiation electrode may be discontinuous between the first connection terminal and the second connection terminal and divided into the first and the second halves. Alternatively, the electric conductor forming the radiation electrode may be continuous from the first half to the second half and have one of the first and the second connection terminals around the center of the radiation electrode.

Each of the first and the second halves may be a quarter-wave antenna. Here, the "quarter-wave antenna" refers to a radiation electrode that has an electrical equivalent length of a quarter of a wavelength for a used frequency to produce resonance.

In the antenna element according to this invention, the electric conductor width of each of the first and the second halves of the radiation electrode may be narrowing from the center toward each of the open ends and the distance between the electric conductors of each of the first and the second halves may be increasing from the center toward each of the open ends.

According to this invention, on a surface of the dielectric substrate on which the radiation electrode is formed, another dielectric substrate may be provided to bury the radiation electrode in the dielectric. The length of the dipole radiation electrode, which is needed to produce resonance at the wavelength related with the frequency of the radiation used by the mobile telecommunication device, depends on an effective dielectric constant $\epsilon reff$ of the substrate having the radiation electrode thereon. Specifically, the length is represented by $\lambda/4\times1/\sqrt{\epsilon reff}$ for the quarter-wave antenna, indicating that the length is in inverse proportion to $\sqrt{\epsilon reff}$. Preferred materials for the dielectric substrate are glass fabric based epoxy resin and alumina ceramics having an effective dielectric constant of about 4 and about 8 to 10, respectively. The higher the effective dielectric constant of the substrate, the shorter the radiation electrode can be made, and burying the radiation electrode in the dielectric can assure the advantage of using the dielectric.

While in the above description, the radiation electrode made of a conductor is formed mainly on one surface of the dielectric substrate, the whole radiation electrode made of a conductor may be formed on that one surface of the dielectric substrate. Alternatively, in the antenna element of this invention, most part of the radiation electrode may be formed on one side of the substrate, and the remainder of the radiation electrode may be formed on a side adjacent to that side.

A telecommunication device according to this invention comprises a printed wiring board and an antenna element mounted on the printed wiring board. The printed wiring board has a ground area of the board with a ground conductor, a ground-free area of the board without a ground conductor and a high frequency signal lead. The antenna element comprises a dielectric substrate, and a radiation electrode of an electric conductor formed mainly on a surface of the dielectric substrate. The dielectric substrate is a dielectric chip, preferably a hexahedron of dielectric material. The antenna element has a power supply conductor and a ground conductor, which are connected to the radiation electrode, on the dielectric substrate, preferably on a surface other than the surface of the dielectric substrate on which the radiation electrode is formed. The antenna element is mounted on the ground-free area of the board so that a dielectric substrate surface other than the dielectric substrate surface on which the radiation electrode is formed faces on the ground-free area.

The radiation electrode having a first and a second halves, the first and the second halves being substantially symmetric in form to one another with respect to the center of the radiation electrode and being to radiate with the same direction of main polarization of radiation emitted from the radiation electrode. The first half has a first open end at its outer end and a first connection terminal adjacent to the center. The second half has a second open end at its outer end and a second connection terminal adjacent to the center, the second connection terminal being at a distance from the first connection terminal on the radiation electrode. A power supply conductor is formed on the dielectric substrate and connected to the first connection terminal at one end of the power supply conductor and has at the other end a terminal connected to the high frequency signal lead on the printed wiring board. A ground conductor is formed on the dielectric substrate and connected to the second connection terminal at one end of the ground conductor and has at the other end a terminal connected to the ground conductor on the printed wiring board.

A portion of the first half between the first open end and the first connection terminal is asymmetric in form to a portion of the second half between the second open end and the second connection terminal. Alternatively, the power supply conductor is asymmetric in form to the ground conductor on the dielectric substrate. Thereby, the total impedance of the power supply conductor and the portion of the first half between the first open end of the first half and the terminal, at the other end of the power supply conductor, connected to the high frequency signal lead and the impedance of the high frequency signal source substantially match, in total impedance, the ground conductor and the portion of the second half between the second open end of the second half and the terminal, at the other end of the ground conductor, connected to the ground conductor on the printed wiring board.

The printed wiring board of the telecommunication device according to this invention preferably has the ground-free area of the board between the ground area of the board and a side edge of the board, and the antenna element is preferably mounted on the ground-free area of the board so that the dielectric substrate surface having the radiation electrode is adjacent to the side edge of the board and a dielectric substrate surface other than the dielectric substrate surface having the radiation electrode faces the ground-free area of the board.

In the telecommunication device according to this invention, since the radiation electrode of the antenna element is spaced apart from the ground conductor on the printed wiring board, the effect of the grounding can be eliminated.

The antenna element of the telecommunication device according to this invention preferably further comprises ground electrodes, formed adjacent to the first and the second open ends on the dielectric substrate, connected to the ground conductor on the printed wiring board, each of the ground electrodes connecting capacitively to the first and the second halves at the first and the second open ends, respectively. The radiation electrode is preferably in a meandering form.

The electric conductor forming the radiation electrode may be discontinuous between the first connection terminal and the second connection terminal and divided into the first and the second halves. Alternatively, the electric conductor forming the radiation electrode may be continuous from the first half to the second half and have one of the first and the second connection terminals around the center of the radiation electrode. Each of the first and the second halves may be a quarter-wave antenna.

In the telecommunication device according to this invention, the electric conductor width of each of the first and the second halves of the radiation electrode may be narrowing from the center toward each of the open ends and the distance between the electric conductors of each of the first and the second halves may be increasing from the center toward each of the open ends.

DETAILED DESCRIPTION OF THE PREFERRED EMBODIMENTS

Figure 1A:
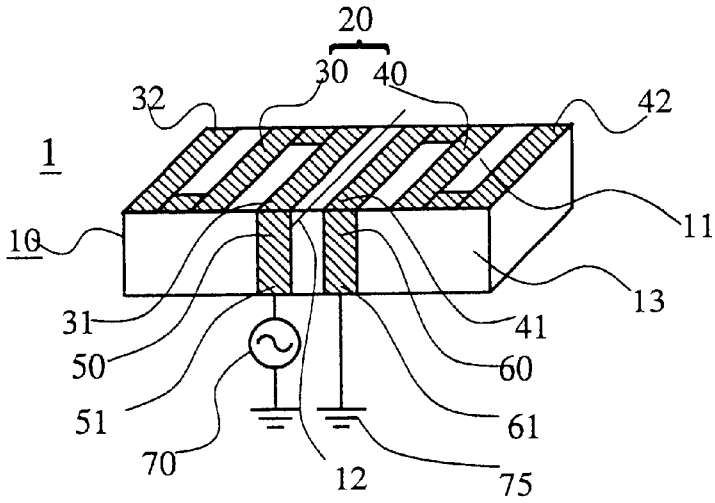
FIG. 1A is a perspective view of an antenna element according to EXAMPLE 1 of the present invention viewed from a front side.

FIG. 1A is a perspective view of an antenna element 1 according to EXAMPLE 1 of the present invention. In this drawing, a radiation electrode 20 is provided on a top surface 11 of a dielectric hexahedron substrate 10, and a first half 30 (left half) and a second half 40 (right half) of the radiation electrode are provided to be substantially symmetric to one another with respect to a center line 12 indicated by a two-dot chain line. Each of the first half 30 and the second half 40 is a quarter-wave antenna. The radiation electrode 20 is shown as a segment in this drawing, which is preferably printed to be continuous.

Since two halves 30, 40 of the radiation electrode are provided on the surface 11 in a symmetric form with respect to the center line 12, they have the same direction of main polarization of radiation emitted therefrom. The first half 30 on the left side has a first connection terminal 31, connected to a power supply conductor 50, at one end thereof adjacent to the second half 40 on the right side, and the power supply conductor 50 is provided on a front surface 13 of the substrate 10. The power supply conductor 50 is connected to the first connection terminal 31 at one end thereof and has at the other end a terminal 51 for connecting to a high frequency signal source 70. The second half 40 on the right side has, at one end thereof adjacent to the first half 30 on the left side, a second connection terminal 41 connected to a ground conductor 60, which is also provided on the front surface 13. The ground conductor 60 has at the other end thereof a terminal 61 for connecting to a ground 75. Outer ends of the first and second halves of the radiation electrode constitute a first open end 32 and a second open end 42, respectively. These open ends 32, 42 are capacitively connected to the ground.

Figure 1B:
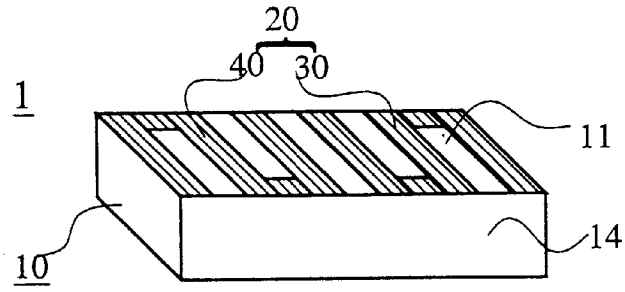
FIG. 1B is a perspective view of the antenna element viewed from a rear side.
Figure 1C:
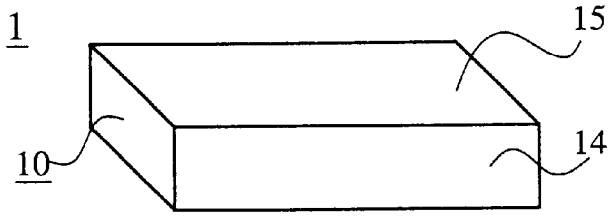
FIG. 1C is a perspective bottom view of the antenna element viewed from a rear side.

For better understanding of the structure of the antenna element 1, FIG. 1B is a perspective view of the antenna element viewed from the opposite side, that is, with a rear side 14 thereof facing frontward, and FIG. 1C is a perspective bottom view of the antenna element 1 with a bottom surface 15 thereof facing upward and the rear side 14 facing frontward. As can be seen from FIGS. 1A through 1C, the antenna element 1 has the radiation electrode 20 only on the top surface 11 and the first and second connection terminals 31, 41 provided adjacent to one another. There is no conductor on the bottom surface 15 and the rear surface 14. Through the bottom surface 15 or rear surface 14, which has no conductor thereon, the antenna element can be mounted on an area, having no ground conductor, of a printed wiring board of a telecommunication device. Typically, a ground conductor is provided on a printed wiring board, and an area without the ground conductor is provided on the printed wiring board and the antenna element 1 is mounted on the area without the ground conductor. The area without the ground conductor may comprise a power supply lead or high frequency signal lead for connecting to the power supply conductor 50, ground lead for connecting to the ground conductor 60, ground electrodes for capacitively connecting to the first and second open ends 32, 42, leads for connecting the ground electrodes to the ground conductor of the printed wiring board or the like as required.

While the radiation electrode shown is in a meandering form, it may be in a helical form or linear form. The meandering form of the radiation electrode allows substantially the whole radiation electrode to be provided on one surface of the hexahedron substrate 10, as well as a long radiation electrode to be provided on a small substrate.

In the construction of the antenna element 1 described above, the power supply conductor 50 and the ground conductor 60 are provided adjacent to one another, so that a capacitance between the power supply conductor 50 and the ground conductor 60 is large. Furthermore, the first and second open ends 32, 42 are spaced apart from one another, so that the interaction therebetween is small, and therefore, the antenna element 1 can be represented by an equivalent circuit shown in FIG. 2A.

Figure 2A:
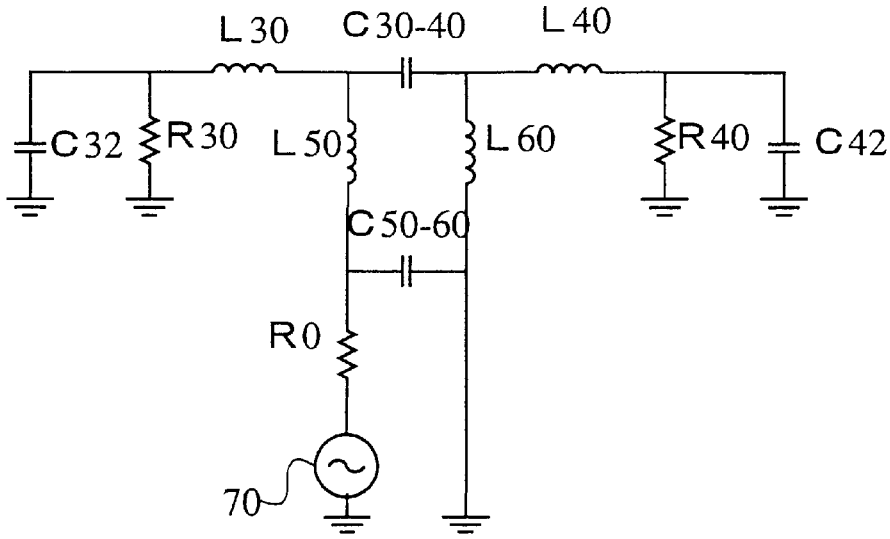
FIG. 2A shows an equivalent circuit of the antenna element according to EXAMPLE 1 of the present invention.

In FIG. 2A, reference symbols L30, L40 denote an inductance of the first and second halves 30, 40 of the radiation electrode 20, respectively, reference symbols L50, L60 denote an inductance of the power supply conductor 50 and the ground conductor 60, respectively, and reference symbols C30-40, C50-60 denote a capacitance between the halves of the radiation electrode and a capacitance between the power supply conductor and the ground conductor, respectively. Furthermore, reference symbols R30, R40 denote a radiation resistance of the halves 30, 40, respectively, and reference symbols C32, C42 denote a ground capacitance between the first open end and the ground and between the second open end and the ground, respectively. Since the halves of the radiation electrode are provided symmetrically, impedance match can be accomplished therebetween. In addition, since the power supply conductor 50 and the ground conductor 60 are provided adjacent to one another on the same surface of the substrate, the capacities C30-40 and C50-60 are large. By adjusting the positional relationship therebetween, the halves of the radiation electrode can be sufficiently matched to one another.

Since matching can be easily achieved, when one of the halves of the radiation electrode emits radiation, resonance is enhanced in both the halves, so that an induced current occurs in the other half of the radiation electrode. Therefore, a circuit on the printed wiring board is less affected, and a change in a resonance frequency or directional pattern can be reduced.

Figure 1D:
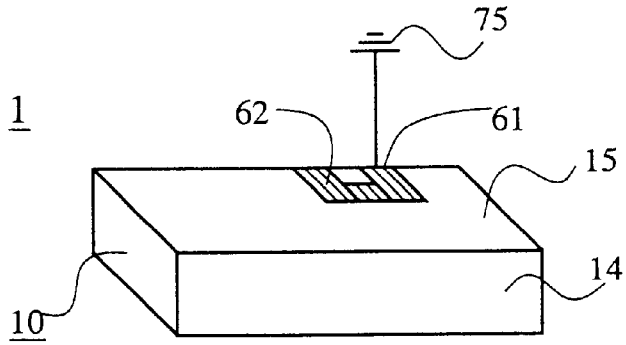
FIG. 1D is a perspective bottom view of the antenna element according to modified EXAMPLE 1 viewed from a rear side.
Figure 2B:
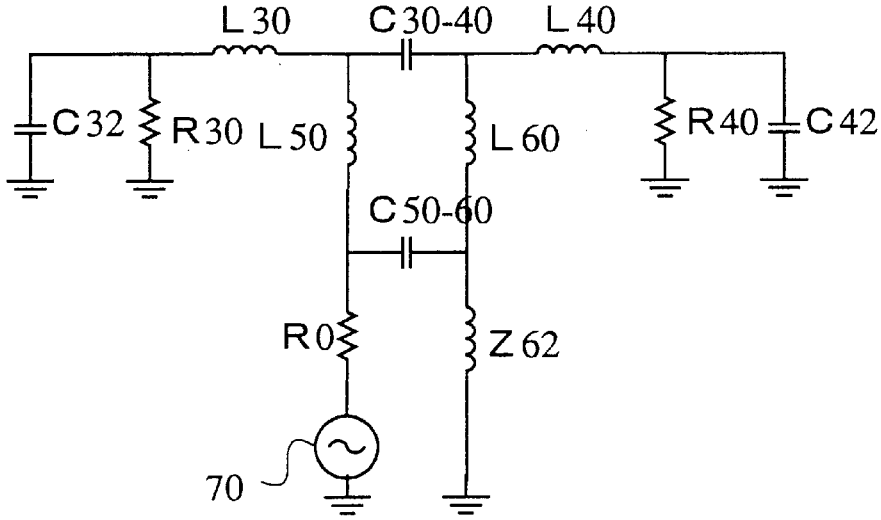
FIG. 2B shows an equivalent circuit of the antenna element according to modified EXAMPLE 1 of the present invention.

In FIG. 2A, reference symbol R0 denotes an impedance of the antenna element 1 from the high frequency signal source 70 to the feeding point (terminal 51 of the power supply conductor 50) including the internal impedance of the high frequency signal source 70, and the total input impedance from the high frequency signal source 70 to the antenna element is typically set at about 50 ohms. In order to provide the ground conductor 60 with an impedance substantially equivalent to the impedance, the ground conductor 60 is extended as shown in the perspective bottom view in FIG. 1D, the extension constituting an impedance adjustment conductor 62. Thus, an equivalent circuit having the impedance Z62 on the side of the ground conductor as shown in FIG. 2B is provided. In this EXAMPLE, the first half 30 and the second half 40 of the radiation electrode are substantially symmetric in form to one another, the power supply conductor 50 and the ground conductor 60 are asymmetric in form to one another, and the impedance of the radiation electrode on the side of the ground conductor can be matched to the impedance thereof on the side of the power supply conductor, that is, the high frequency signal source 70, so that resonance in a wide bandwidth can be realized.

Figure 3A:
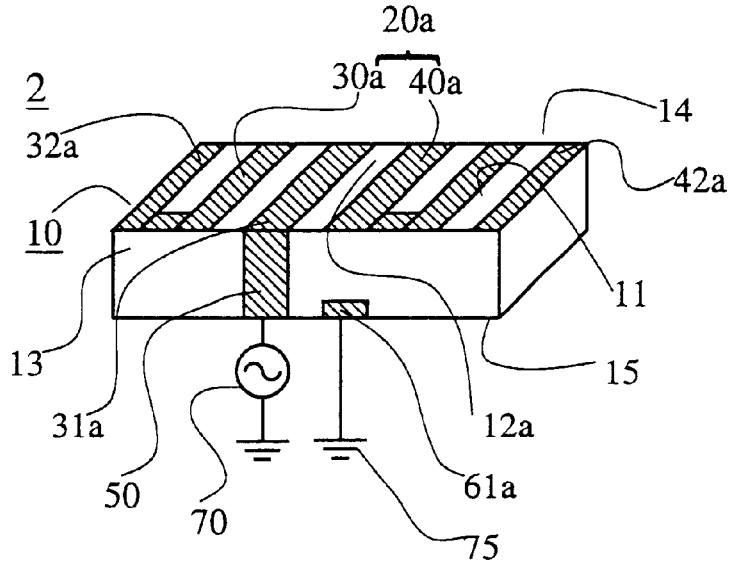
FIG. 3A is a perspective view of the antenna element according to EXAMPLE 2 of the present invention viewed from the front side.
Figure 3B:
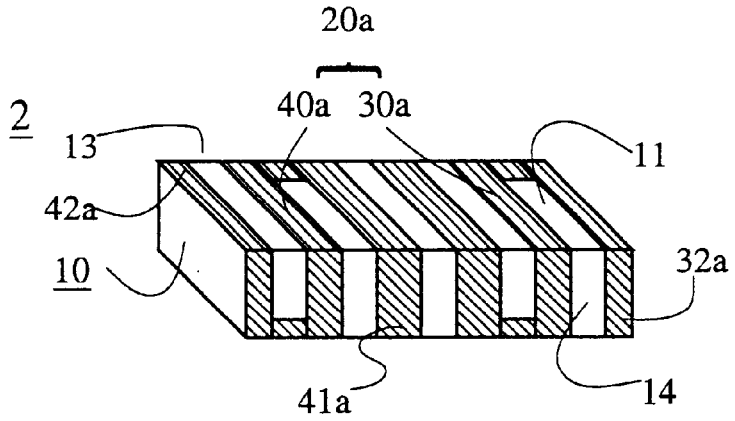
FIG. 3B is a perspective view of the antenna element viewed from the rear side.
Figure 3C:
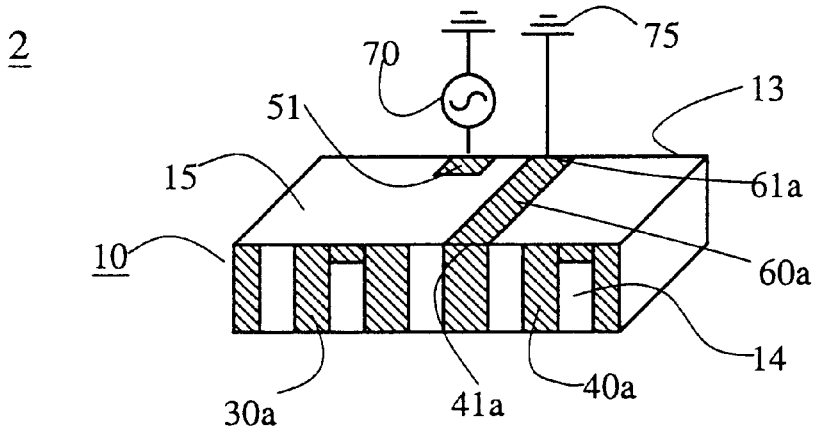
FIG. 3C is a perspective bottom view of the antenna element viewed from the rear side.

FIG. 3 shows an antenna element 2 of EXAMPLE 2. In FIG. 3, the same components as in FIG. 1 are denoted by the same reference symbols. FIG. 3A is a perspective view, in which a first half 30*a* and a second half 40*a* of a radiation electrode 20*a* are provided in a form rotationally symmetric about a point 12*a* over the top surface 11 and the rear surface 14 of the dielectric hexahedron substrate 10. While the radiation electrode 20*a* is provided on the adjacent two surfaces 11, 14, it is mainly provided on the top surface 11, and in the state where the two surfaces are developed, the first half and the second half are rotationally symmetric to one another about the point 12*a*. The first half 30*a* and the second half 40*a* of the radiation electrode are both quarter-wave antennas. FIG. 3B is a perspective view in which the top surface 11 faces upward and the rear surface 14 faces frontward, and FIG. 3C is a perspective bottom view in which the bottom surface 15 of the antenna element 2 faces upward and the rear surface 14 faces frontward. The first half 30*a* of the radiation electrode on the left side in FIG. 3A has a first connection terminal 31*a*, connected to the power supply conductor 50, at one end thereof adjacent to the second half 40*a* on the right side, and the power supply conductor 50 is provided on the front surface 13 of the substrate 10. The second half 40*a* on the right side has, at one end thereof adjacent to the first half 30*a* on the left side, a second connection terminal 41*a* connected to a ground conductor 60*a*. The ground conductor 60*a* is provided on the bottom surface 15 of the substrate 10 and has at the other end thereof a terminal 61*a* for connecting to the ground.

The other ends of the first half 30*a* and the second half 40*a* of the radiation electrode constitute open ends 32*a* and 42*a*, respectively. Although the power supply conductor 50 and the ground conductor 60*a* are provided on different surfaces, that is, on the front surface 13 and on the bottom surface 15, respectively, since the portions of the first and second halves 30*a* and 40*a* of the radiation electrode which are adjacent to the center of symmetry are provided adjacent to one another, and the power supply conductor 50 and the ground conductor 60*a* are located relatively near to one another, the capacitance between the halves of the radiation electrode is large, and resonance is easy to produce. In the example shown in this drawing, the first half 30*a* and the second half 40*a* of the radiation electrode are substantially symmetric in form to one another, the ground conductor 60*a* is longer than and is asymmetrical in form to the power supply conductor 50. This brings about a state where the impedance adjustment conductor is added to the side of the ground conductor 60*a*. Thus, it will be understood that the equivalent circuit shown in FIG. 2B is provided also in this EXAMPLE. In addition, impedance match between the half of the radiation electrode on the side of the high frequency signal source and the half of the radiation electrode on the side of the ground conductor is easy to achieve.

The first half 30*a* and the second half 40*a* of the radiation electrode are in a meandering form, and each of the conductors is wider in the portion near the center than the portion near the open end. In the case of the quarter-wave antenna, the amplitude of current is large at the power supply side end and small at the open end, so that the conductor loss can be reduced by widening the conductor at the portion where the amplitude of current is large.

Figure 4:
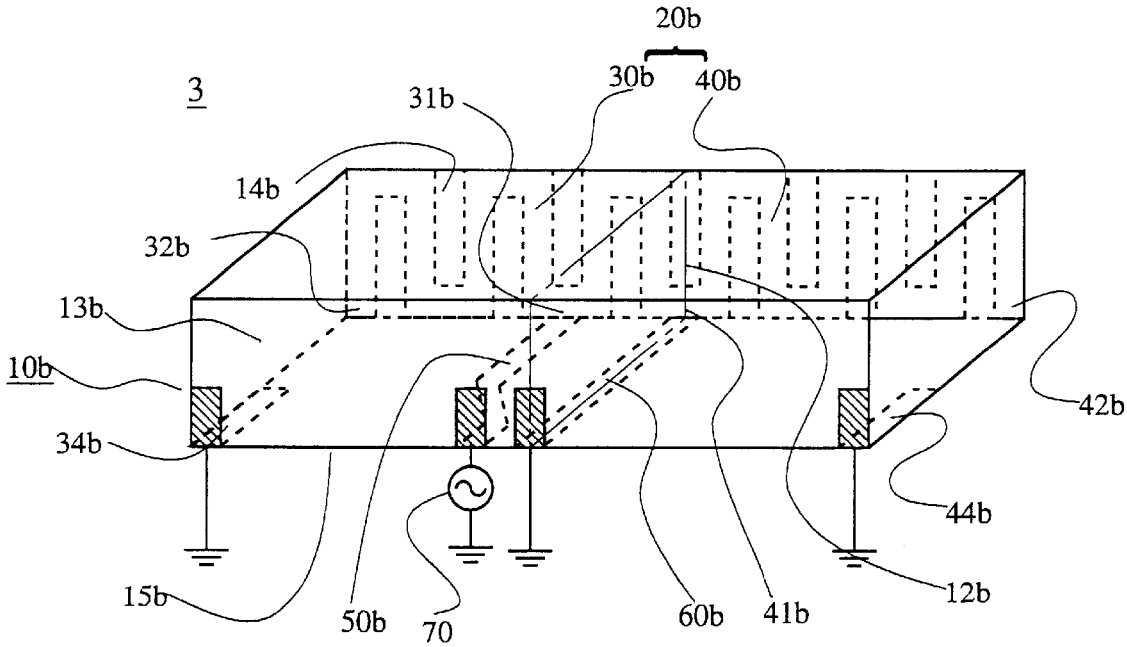
FIG. 4 is a perspective view of the antenna element according to EXAMPLE 3 of the present invention.

FIG. 4 is a perspective view of an antenna element 3 of EXAMPLE 3. In this drawing, a meandering radiation electrode 20*b* is provided symmetrically with respect to a center line 12*b*, indicated by a two-dot chain line, on a rear surface 14*b* of a dielectric hexahedron substrate 10*b*. Here, a first half 30*b* on the left side and a second half 40*b* on the right side of the radiation electrode 20*b* are symmetric in form to one another with respect to the center (intersection of the center line 12*b* and the radiation electrode 20*b*) 41*b*. Each of the halves 30*b* and 40*b* of the radiation electrode 20*b* constitute a quarter-wave antenna.

Since the radiation electrode 20*b* is provided symmetrically with respect to the center 41*b* thereof to extend in the longitudinal direction of the substrate 10*b*, the halves have the same direction of main polarization of radiation emitted therefrom. A ground conductor 60*b*, which is grounded, extends from a front surface 13*b* and across a bottom surface 15*b* to be connected to the center 41*b* of the radiation electrode 20*b*, so that the center 41*b* constitutes a second connection terminal of the ground conductor 60*b*. A power supply conductor 50*b* connected to the high frequency signal source 70 also extends from the front surface 13*b* and across the bottom surface 15*b* to be connected to a first connection terminal 31*b* spaced apart from the center 41*b* of the radiation electrode 20*b* by a predetermined distance. In addition, the outer ends of the radiation electrode 20*b* constitute a first open end 32*b* and a second open end 42*b*. The first and second open ends 32*b*, 42*b* are capacitively connected to ground electrodes 34*b*, 44*b*, respectively, that are provided at both ends of the bottom surface 15*b* of the substrate 10*b*. The impedance of the portion of the radiation electrode between the second connection terminal 41*b* for connecting the ground conductor 60*b* to the radiation electrode and the first connection terminal 31*b* and the impedance of the portion of the radiation electrode between the open end 32*b* of the radiation electrode and the first connection terminal 31*b* can be adjusted by varying the position of the first connection terminal 31*b* for connecting the power supply conductor 50*b* to the first half 30*b* of the radiation electrode 20*b*. The impedance can also be adjusted by varying the length of the power supply conductor 50*b*. In addition, the capacitance between the power supply conductor 50*b* and the ground conductor 60*b* can be adjusted by varying the patterns thereof. Through the adjustment of these impedances, the impedance between the radiation electrode and the high frequency signal source can be arbitrarily adjusted, so that impedance match can be easily achieved. That is, as is apparent from the drawing in this EXAMPLE, the first half 30*b* of the radiation electrode between the first open end 32*b* and the first connection terminal 31*b* and the second half 40*b* of the radiation electrode between the second open end 42*b* and the second connection terminal 41*b* are asymmetric to one another in form. While the power supply conductor 50*b* and the ground conductor 60*b* are substantially symmetric in form to one another, they may be asymmetric in form to one another to achieve impedance match.

As can be seen from FIG. 4, in the antenna element 3, the radiation electrode 20*b* is provided only on the rear surface 14*b* of the substrate 10*b*, and the power supply conductor 50*b* and the ground conductor 60*b* are provided adjacent to one another on the bottom surface 15*b*. By mounting the antenna element via the bottom surface 15*b* on the area without a ground conductor of the printed wiring board of the telecommunication device, the power supply conductor 50*b* and the ground conductor 60*b* can be connected to the ground lead or power supply lead mounted on the printed wiring board. While a ground conductor is typically provided on the printed wiring board of the telecommunication device, an area having no ground conductor mounted thereon or having any ground conductor removed therefrom may be provided in a region adjacent to an end of the printed wiring board to create an antenna mounting port, and the antenna element 3 may be mounted on the region.

While the radiation electrode shown is in a meandering form, it may be in a helical form or linear form. The meandering or helical form of the radiation electrode allows the size of the substrate 10*b* to be reduced.

In the construction of the antenna element 3 described above, the power supply conductor 50*b* and the ground conductor 60*b* are provided adjacent to one another, so that a capacitance between the power supply conductor 50*b* and the ground conductor 60*b* is large. Furthermore, the open ends 32*b*, 42*b* of the radiation electrode are spaced apart from one another, so that the interaction therebetween is small, and therefore, the antenna element 3 can be represented by an equivalent circuit shown in FIG. 5.

Figure 5:
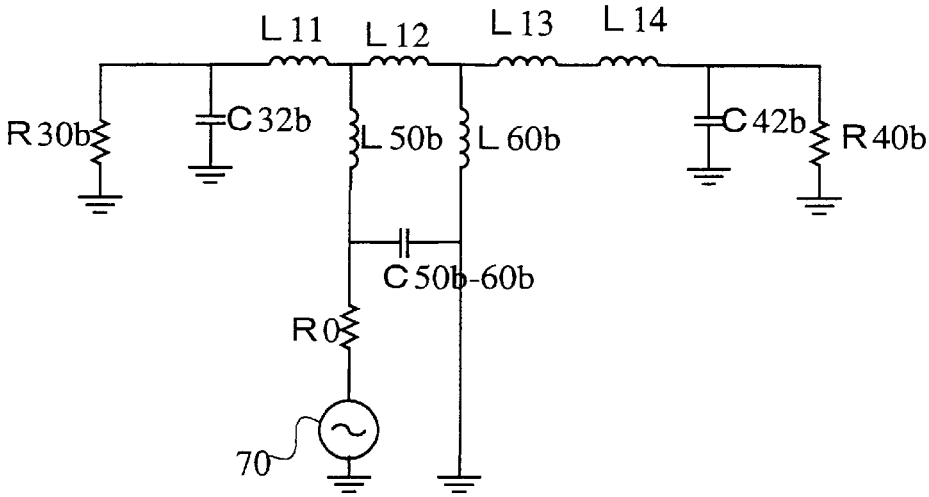
FIG. 5 shows an equivalent circuit of the antenna element according to EXAMPLE 3.

In FIG. 5, reference symbols L11, L12 denote an inductance of the left half of the radiation electrode 20*b*, reference symbols L13, L14 denote an inductance of the right half of the radiation electrode 20*b*, reference symbols L50*b*, L60*b* denote an inductance of the power supply conductor 50*b* and the ground conductor 60*b*, respectively, and reference symbol C50*b*-60*b* denotes a capacitance between the power supply conductor and the ground conductor. Furthermore, reference symbols R30*b*, R40*b* denote a radiation resistance of the radiation electrode. And, reference symbol R0 denotes an input impedance including the internal impedance of the high frequency signal source 70, and reference symbols C32*b*, C42*b* denote capacitive couplings between the open ends of the radiation electrode and the respective ground electrode. Since the radiation electrode has a form substantially symmetrical with respect to the center 41*b* at which the ground conductor 60*b* is connected to the radiation electrode 20*b*, as for an equivalent inductance of the radiation electrode, the sum of the inductances of L11 and L12 equals to the sum of the inductances of L13 and L14. The inductances L11 and L12 can be varied by adjusting the position of the first connection terminal 31*b* for connecting the power supply conductor 50*b* to the radiation electrode 20*b*. The inductances L50*b* and L60*b* can be adjusted by varying the patterns of the power supply conductor 50*b* and the ground conductor 60*b*, respectively. The capacitance C50*b*-60*b* can be adjusted by varying the distance between the power supply conductor 50*b* and the ground conductor 60*b*. In this way, impedance match can be achieved between the half of the radiation electrode on the side of the high frequency signal source 70 and the half of the radiation electrode on the side of the ground conductor, so that a change in the resonance frequency or directional pattern can be reduced.

Figure 6:
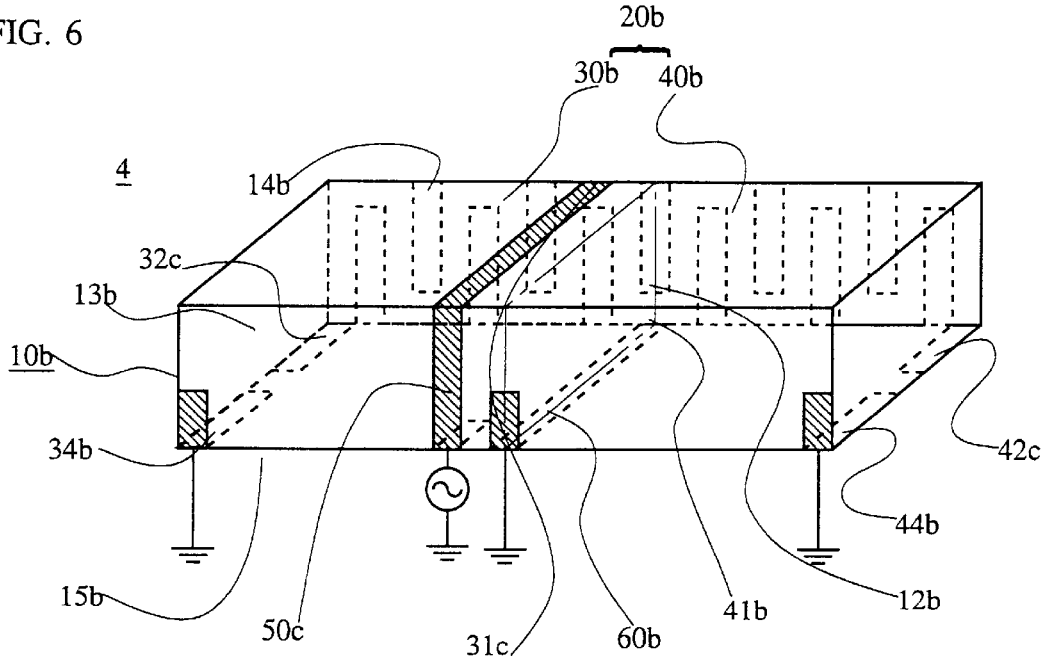
FIG. 6 is a perspective view of the antenna element according to EXAMPLE 4 of the present invention.

FIG. 6 is a perspective view of an antenna element 4 of EXAMPLE 4. The same components as in FIG. 4 are denoted by the same reference symbols. In this EXAMPLE, the substrate 10*b*, radiation electrode 20*b*, ground conductor 60*b*, and ground electrodes 34*b*, 44*b* have the same configuration as those shown in FIG. 4. A power supply conductor 50*c* extends from the front surface 13*b* of the substrate 10*b* and across the top surface 11*b*, has a first connection terminal 31*c* distant from the center 41*b* of the radiation electrode, and is connected to the radiation electrode 20*b* at the terminal.

Open ends 32*c*, 42*c* of the radiation electrode 20*b* of the antenna element are provided on the bottom surface 15*b* by extending the radiation electrode from the rear surface 14*b* along the surface of the substrate. Since the distances between the open ends 32*c*, 42*c* of the radiation electrode and the ground electrodes 34*b*, 44*b*, respectively, can be made smaller than those in EXAMPLE 3 shown in FIG. 4, the capacitive couplings therebetween can be enhanced. Consequently, the resonance frequency is lowered, and the radiation electrode can be shortened, so that the antenna element can be miniaturized further.

In EXAMPLE 3 in FIG. 4 and EXAMPLE 4 in FIG. 6, the ground electrodes 34*b*, 44*b* are provided from the front surface 13*b* to the bottom surface 15*b* on the substrate 10*b*. Since the ground electrodes 34*b*, 44*b* are mounted on the substrate 10*b* in such a manner, the distance between the ground electrode and the open end of the radiation electrode is determined on the antenna element, so that the capacitance is kept constant regardless of the mount condition of the antenna element on the printed wiring board, and a stable characteristic can be realized.

Instead of providing the ground electrodes on the substrate, the ground electrodes may be provided on the printed wiring board on which the antenna element is mounted. On the printed wiring board on which the antenna element is mounted, similar ground electrodes are provided at positions facing the ground electrodes otherwise provided on the substrate, thereby capacitive couplings with the open ends of the radiation electrode can be accomplished. However, the value of the capacitance varies depending on the mount condition of the antenna element on the printed wiring board, so that the mount condition needs to be always the same.

Figure 7:
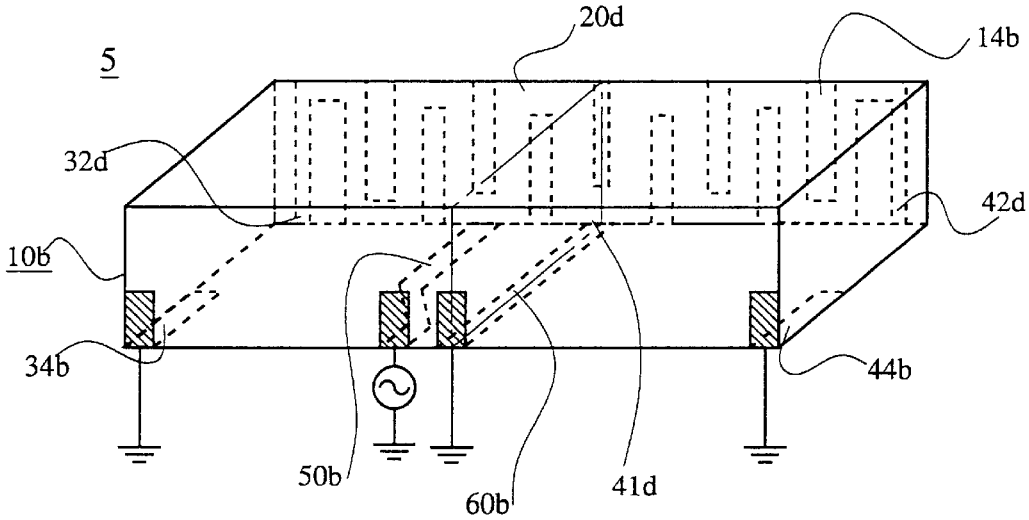
FIG. 7 is a perspective view of the antenna element according to EXAMPLE 5 of the present invention.

FIG. 7 is a perspective view of an antenna element 5 of EXAMPLE 5. In this drawing, the same components or parts as in FIG. 4 are denoted by the same reference symbols. In this embodiment, the substrate 10*b*, power supply conductor 50*b*, ground conductor 60*b*, and ground electrodes 34*b*, 44*b* have the same configuration as those shown in FIG. 4.

The antenna element 5 is similar to the antenna element 3 in that a radiation electrode 20*d* is provided on the rear surface 14*b* of the substrate 10*b* and extends symmetrically with respect to the center 41*b* in the longitudinal direction of the substrate. And, the length of each of the halves of the radiation electrode extending from the center 41*b* to the open ends 32*d*, 42*d* also is a quarter of the wavelength. However, the radiation electrode 20*d* becomes narrower from the center toward the outer open ends, and the distance between the vertical conductors of the radiation electrode becomes wider from the center toward the outer open ends.

A high frequency current appearing in the radiation electrode in a resonant state of the antenna has a maximum value at the center of the radiation electrode and a minimum value at the both ends. Therefore, by configuring the conductor of the radiation electrode so as to become narrower from the center toward the tips thereof, the radiation electrode can be miniaturized without causing a loss. Furthermore, a high frequency voltage appearing in the radiation electrode in a resonant state of the antenna has a minimum value at the center of the radiation electrode and a maximum value at the both ends. Therefore, by widening the distance between the conductors of the radiation electrode from the center toward the tips thereof, concentration of the electric field among the conductors can be alleviated. In addition, the tips of the radiation electrode emitting radiation can be less affected by the other portions of the radiation electrode. Thus, the radiation efficiency can be enhanced.

Figure 8:
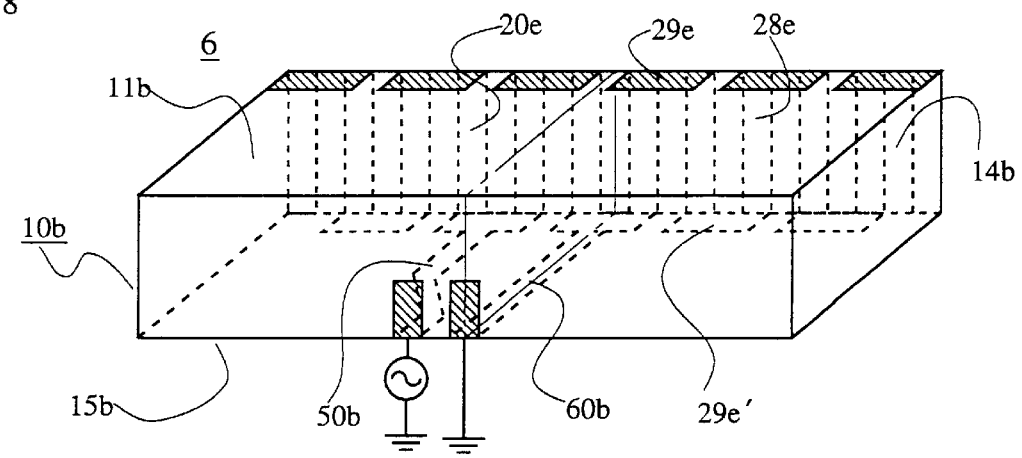
FIG. 8 is a perspective view of the antenna element according to EXAMPLE 6 of the present invention.

FIG. 8 is a perspective view of an antenna element 6 of EXAMPLE 6. In this drawing, the same components or parts as in FIG. 4 are denoted by the same reference symbols. In this EXAMPLE, the substrate 10*b*, power supply conductor 50*b*, and ground conductor 60*b* have the same configuration as those shown in FIG. 4.

Each of halves of a radiation electrode 20*e*, which extend from the center to the outer open ends, has a length of $\lambda/4$. Vertical conductors 28*e* of the radiation electrode 20*e* are provided on the rear surface 14*b* of the substrate 10*b*, and horizontal conductors 29*e* and 29*e*' interconnecting the vertical conductors 28*e* are provided on the top surface 11*b* and the bottom surface 15*b* of the substrate 10*b*, respectively. Compared with EXAMPLE 3 shown in FIG. 4, if the substrate 10*b* used has the same size, the radiation electrode in this embodiment can be longer than that in EXAMPLE 3. Therefore, the antenna element 6 can deal with a lower frequency.

When the antenna element 6 is mounted on the printed wiring board, part of the radiation electrode 20*e* may approach the ground surface of the printed wiring board, and thus an induced current produced in the substrate ground surface may be increased, thereby reducing efficiency. Therefore, the radiation electrode needs to be prevented from approaching the ground surface of the substrate.

FIG. 9 is a perspective view of EXAMPLE 7. FIG. 9A shows a printed wiring board 80 and an antenna element 2*a* mounted thereon. Also in FIG. 9, the same components as in FIGS. 1 through 8 are denoted by the same reference symbols. The printed wiring board 80 includes an area having a ground conductor 82 and an area 83 in which a base material of the substrate is exposed and no ground conductor is provided, and the area 83 on which the antenna element is to be mounted is adjacent to an end 81 of the substrate 80. As shown in the enlarged view of FIG. 9B, a power supply lead 71, a ground lead 84, and floating electrodes for fixing 85, 85' are mounted on the area 83. The power supply lead 71 is supplied with power via a printed wire on the rear surface of the printed wiring board and the ground lead 84 is connected to a substrate ground conductor 82. The antenna element 2*a* is substantially the same as the antenna element 2 in EXAMPLE 2, and the first half 30*a* on the left side of the radiation electrode 20*a* and the second half 40*a* on the right side thereof are both quarter-wave antennas. However, the antenna element 2*a* differs from the antenna element 2 in that, as shown in FIGS. 9A, 9C and 9D, additional electrodes 39 and 49 are provided from the bottom surface 15 to the front surface 13 at both the ends of the substrate 10 for soldering to the floating electrodes 85, 85' on the printed wiring board 80. Here, FIG. 9C is a perspective view of the antenna element 2*a*, and FIG. 9D is a perspective bottom view thereof. A terminal 61*a*, which is constituted by a portion of the ground conductor 60*a* folded over the front surface 13, and the power supply conductor 50 are soldered to the ground lead 84 and the power supply lead 71 mounted on the printed wiring board, respectively, and the additional electrodes 39, 49 are soldered to the floating electrodes 85, 85', respectively, so that the antenna element 2*a* is firmly attached to the printed wiring board 80. Even if the antenna element is used in a telecommunication device such as a mobile telecommunication device, the antenna element can be prevented from being loosened or falling off during handling thereof.

Figure 9A:
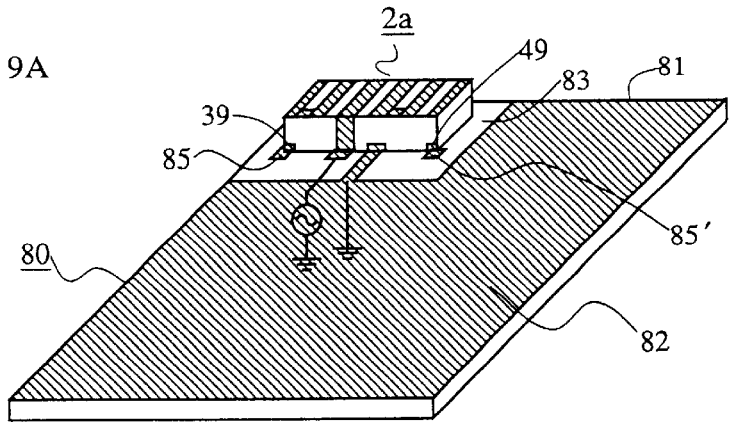
FIG. 9A is a perspective view of a telecommunication device according to EXAMPLE 7 of the present invention having the antenna element of this invention mounted on a printed wiring board.
Figure 9B:
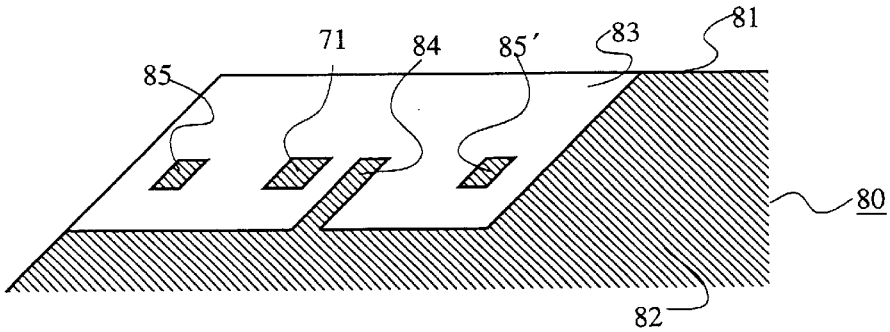
FIG. 9B is an enlarged perspective view of the telecommunication device, showing an area of the printed wiring board on which the antenna element is to be mounted.
Figure 9C:
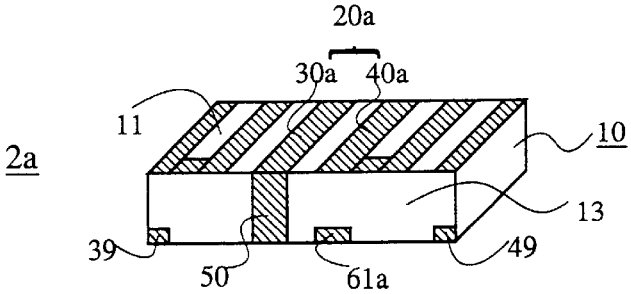
FIG. 9C is a perspective view of the antenna element viewed from the front side.
Figure 9D:
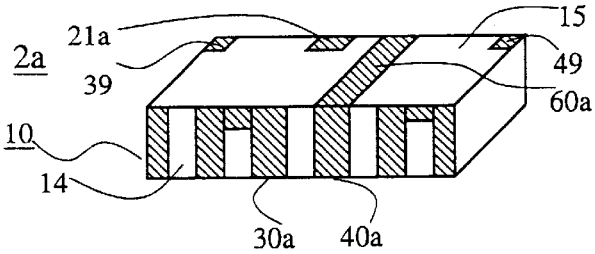
FIG. 9D is a perspective bottom view of the antenna element in FIG. 9C viewed from the rear side.
Figure 9E:
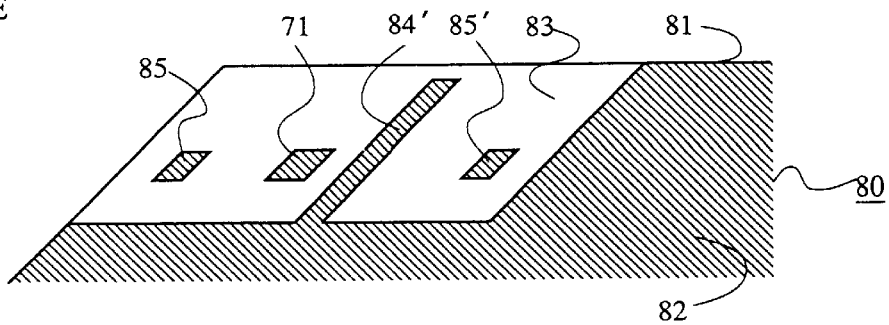
FIG. 9E is an enlarged view of the telecommunication device, showing a modification of the area shown in FIG. 9B.

Furthermore, FIG. 9E shows a modification of the area 83 in the printed wiring board having no ground conductor shown in the enlarged view of FIG. 9B. In FIG. 9E, the ground lead 84' is longer than the ground lead 84 in FIG. 9B so that it reaches the rear surface 14 of the antenna element 2*a*. Since a tip of the ground lead 84' can be soldered to the second half 40*a* of the radiation electrode at the rear surface, the substrate 10 of the antenna element 2*a* can be fixed to the board 80 at the front surface 13 and the rear surface 14 thereof, so that vibration resistance is enhanced. Furthermore, the longer ground lead 84' serves as an impedance adjustment conductor, thereby providing an excellent matching with the poser supply side.

As is apparent from FIG. 9A, the antenna element 2*a* is mounted on the area 83 of the printed wiring board 80 having no ground conductor through the surface of the substrate having no radiation electrode, that is, the bottom surface 15 thereof with the rear surface 14 of the substrate having the radiation electrode located at the end 81 of the board 80, and the top surface 11 and the rear surface 14 having the radiation electrode are distant from the ground conductor 82 and the circuit conductor on the printed wiring board. By making the radiation electrode distant from the ground conductor and the circuit conductor in such a manner, the effect of grounding is reduced, and the radiation efficiency is increased.

Figure 10:
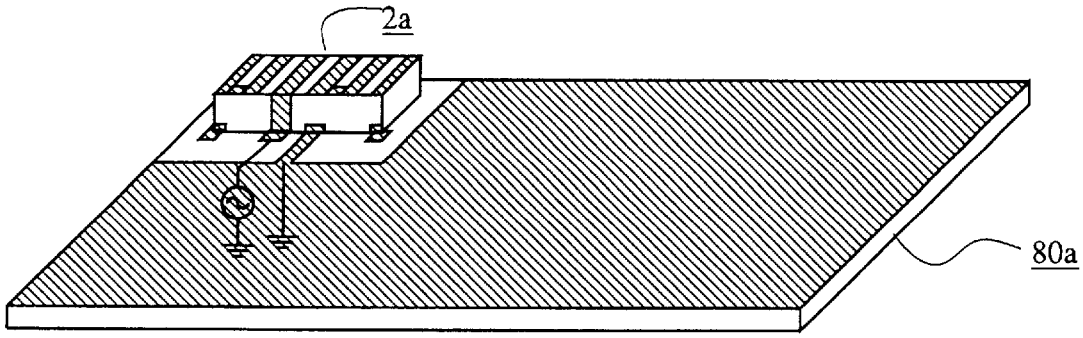
FIG. 10 is a perspective view of the telecommunication device according to EXAMPLE 8 of the present invention having the antenna element of this invention mounted on the printed wiring board.

FIG. 10 is a perspective view of a printed wiring board 80*a* on which the antenna element 2*a* is mounted according to EXAMPLE 8. In this example, the antenna element is mounted so that the radiation electrode is parallel to the longitudinal direction of the printed wiring board 80*a*. Except that, the telecommunication device shown in FIG. 10 is identical to that shown in FIG. 9.

Figure 11:
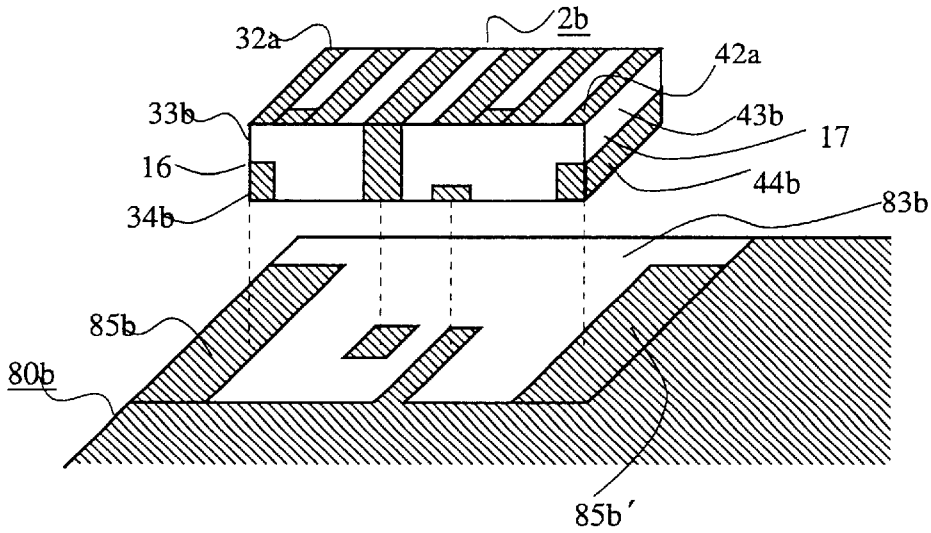
FIG. 11 is an exploded perspective view of the telecommunication device according to EXAMPLE 9 of the present invention, having the antenna element of this invention mounted on the area of the printed wiring board on which the antenna element is to be mounted.

FIG. 11 is a perspective view of EXAMPLE 9, showing the printed wiring board 80*b* and the antenna element 2*b* before being mounted thereon. The antenna element 2*b* is essentially the same as the antenna element 2*a*, but the first open end 32*a* and the second open end 42*a* of the respective halves of the radiation electrode are capacitively connected to the ground electrodes 34*b* and 44*b* provided on the side surfaces 16 and 17 with intervals 33*b* and 43*b* therebetween, respectively. Since the open ends of the halves of the radiation electrode have a large capacitance, the radiation electrode can be shortened. In addition, on the area 83*b* of the printed wiring board 80*b* having no ground conductor, ground electrodes 85*b*, 85*b*' are provided in stead of the floating electrodes 85, 85' shown in FIG. 9, and the ground electrodes 34*b*, 44*b* of the antenna element 2*b* can be soldered to the ground electrodes 85*b*, 85*b*', respectively, so that the vibration resistance is further enhanced.

Figure 12A:
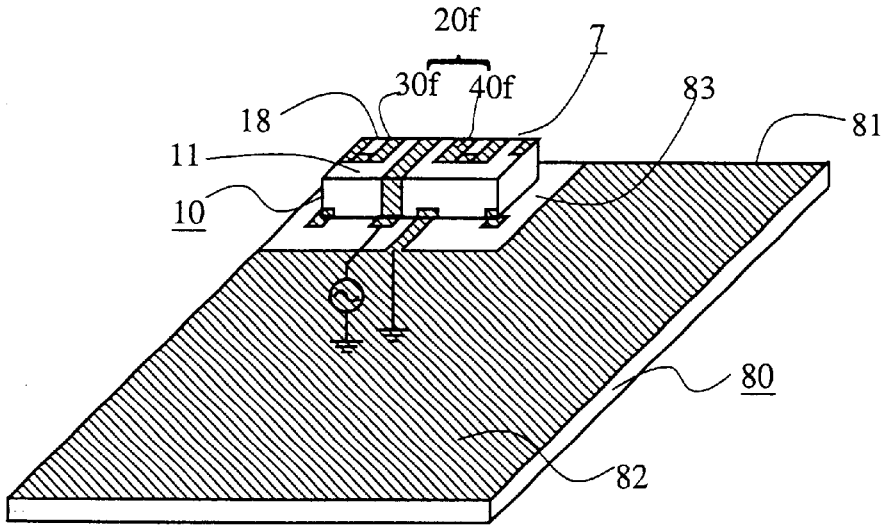
FIG. 12A is a perspective view of the telecommunication device according to EXAMPLE 10 of the present invention having the antenna element of this invention mounted on the printed wiring board.
Figure 12B:
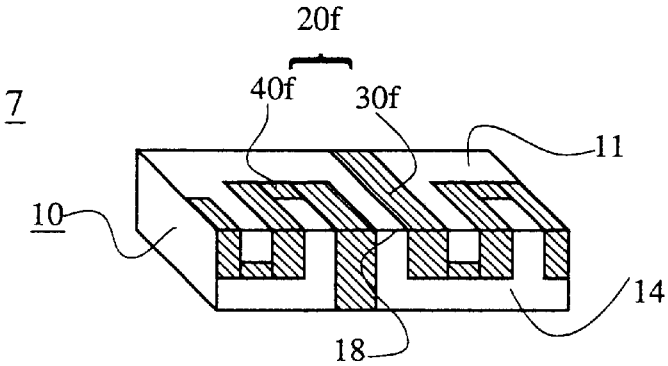
FIG. 12B is a perspective bottom view of the antenna element in FIG. 12A viewed from the rear side.

FIG. 12 is a perspective view of EXAMPLE 10, in which FIG. 12A shows an antenna element 7 mounted on the printed wiring board 80, and FIG. 12B is a perspective view of the antenna element 7 viewed from the rear side 14. Also in FIG. 12, the same components as in FIGS. 1 through 11 are denoted by the same reference symbols.

A radiation electrode 20*f* in this embodiment is provided only on the top surface 11 and the rear surface 14 of the dielectric hexahedron substrate 10 in a meandering form. The antenna element 7 is mounted on the area 83 of the printed wiring board 80 having no ground conductor through the bottom surface having no radiation electrode with the rear surface 14 of the substrate having the radiation electrode 20*f* located at the end 81 of the board 80. Each of a first half 30*f* and a second half 40*f* of the radiation electrode 20*f* is a quarter-wave antenna. Since the radiation electrode is disposed on the top surface 11 and the rear surface 14 centering around a ridge 18 of the substrate 10 distant from the ground conductor 82 of the printed wiring board 80 (the ridge defined by the top surface 11 and the rear surface 14), the portions of the folded conductors of the radiation electrode adjacent to the first connection terminal and the second connection terminal of the halves of the radiation electrode are distant from the ridge, and the nearer to the open ends of the radiation electrode, the closer to the ridge the radiation electrode gets. That is, the distance between the folded conductor of the radiation electrode and the ground conductor 82 of the printed wiring board is gradually increased from the power supply terminal and the ground terminal of the radiation electrode toward the open ends thereof. In this way, by making the antenna tip most significantly affected by the grounding distant from the ground, the radiation efficiency is enhanced.

Figure 13A:
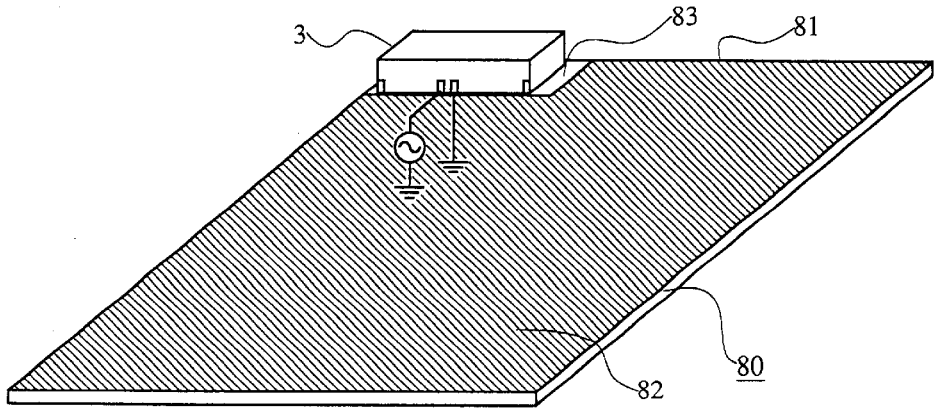
FIG. 13A is a perspective view of the telecommunication device according to EXAMPLE 11 of the present invention having the antenna element of this invention mounted on the printed wiring board.

FIG. 13 is a perspective view of EXAMPLE 11 of the present invention. FIG. 13A shows an antenna element 3 mounted on the exposed board area 83 of the printed wiring board 80. Each of the halves of the radiation electrode 20*b* of the antenna element 3 is a quarter-wave antenna. While the ground conductor 82 is mounted substantially on the whole of the printed wiring board 80, the area 83 having no ground conductor 82 (exposed board area) is provided in the area adjacent to the end 81 of the printed wiring board 80, and the area constitutes an antenna mount area.

Figure 13B:
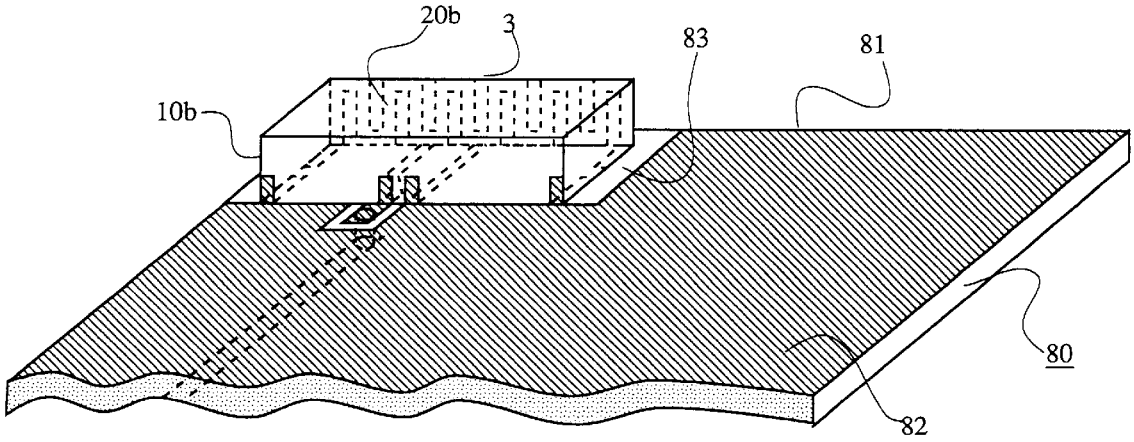
FIG. 13B is an enlarged perspective view of essential parts of the telecommunication device.

FIG. 13B is an enlarged perspective view of the area of the printed wiring board on which the antenna element 3 is mounted, showing the mount condition of the antenna element 3. In addition, for more readily understanding of the mount condition of the antenna element 3 onto the printed wiring board 80, FIG. 14 is a perspective view of the antenna element before being mounted on the printed wiring board.

Since the ground conductor 82 of the printed wiring board 80 is in the form of a sheet, it can also be referred to as a ground conductor surface. If a laminated substrate is used as the printed wiring board, the ground conductor 82 may not be the outermost layer, but an internal layer, such as a second or third layer, and an insulating layer may be disposed thereon.

The ground lead 84 and electrodes 85*c*, 85*c*' extending from the ground conductor 82 toward the exposed board area 83 are provided, connected to the ground conductor 60*b* and the ground electrodes 34*b*, 44*b* of the antenna element 3, respectively, and grounded. On a portion of the antenna mount area corresponding to the power supply conductor 50*b* of the antenna element 3, the power supply lead 71 for connecting to the power supply conductor 50 is provided so that the antenna element is connected to the high frequency signal source (not shown in FIGS. 13B and 14) by the lead 74 through a through-hole 73. In addition, floating electrodes 86, 86', 87, and 87' are provided on the exposed board area 83 so that the respective conductors on the bottom surface of the antenna element 3 can be soldered thereto. In this way, since the antenna element 3 is soldered to the printed wiring board 80 at many portions, even if the antenna element is used in a telecommunication device such as a mobile telecommunication device, the antenna element can be prevented from being loosened or falling off during handling thereof.

Figure 14:
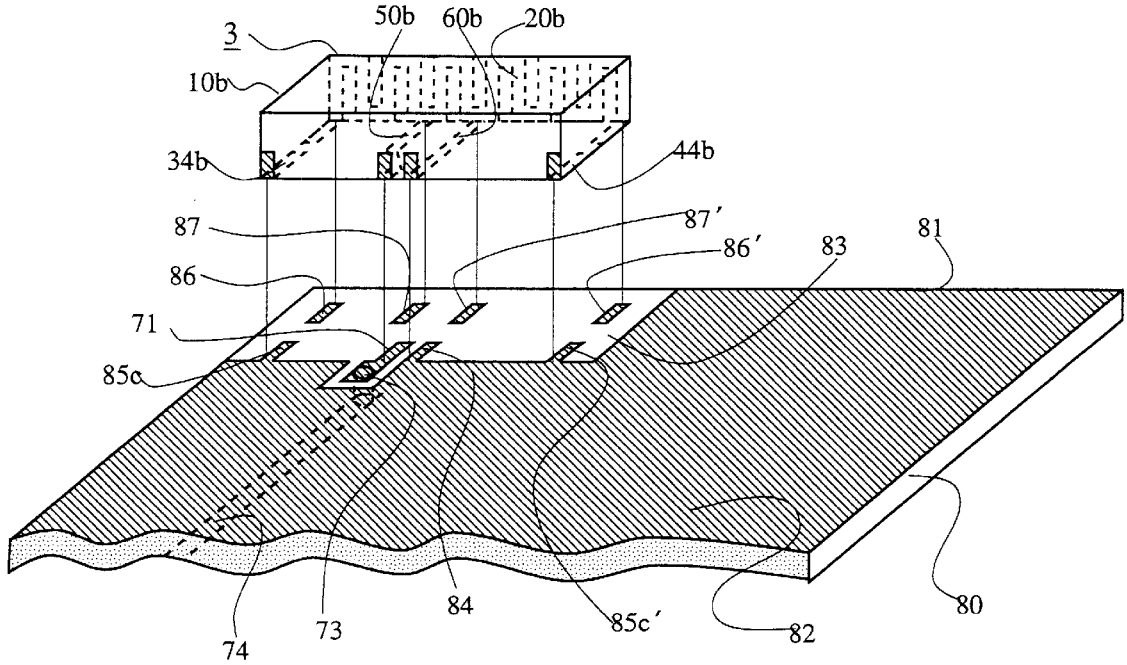
FIG. 14 is an exploded perspective view of the telecommunication device shown in FIG. 13.

As is apparent from FIGS. 13 and 14, since the antenna element 3 is mounted in such a manner that the radiation electrode thereof is close to the end 81 of the printed wiring board 80, the radiation electrode is distant from the ground conductor 82 of the printed wiring board 80 and less affected by the induced current produced in the ground surface, so that a high radiation efficiency can be realized.

Figure 15:
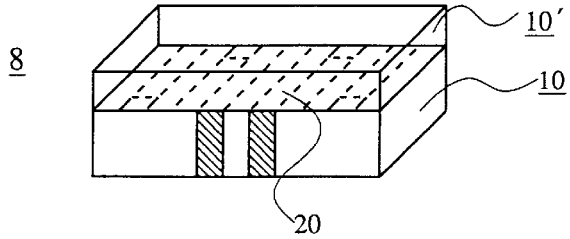
FIG. 15 is a perspective view of a modification of the antenna element according to the present invention.
Figure 16A:
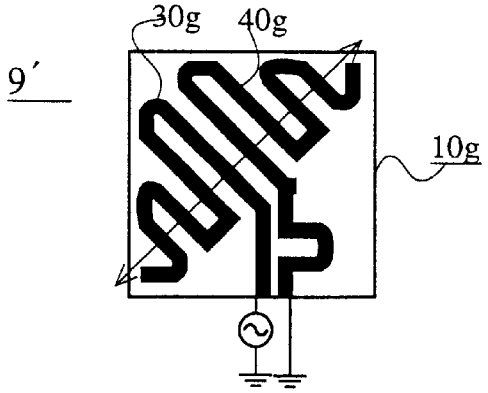
FIG. 16A is a plan view of another modification of the antenna element according to the present invention.
Figure 16B:
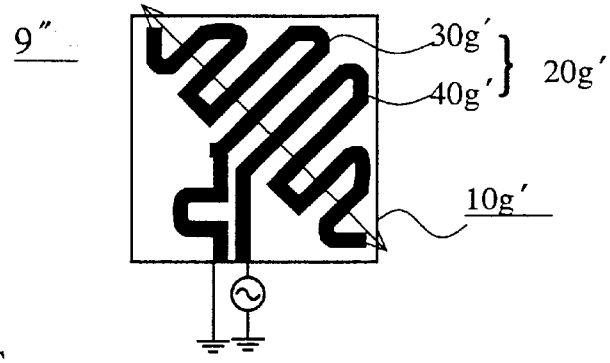
FIG. 16B is a plan view of another modification of the antenna element according to the present invention.
Figure 16C:
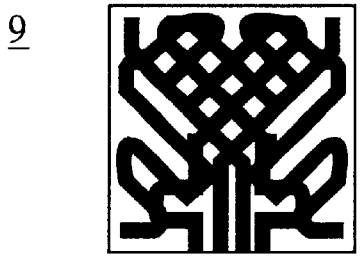
FIG. 16C is a plan view of another modification of the antenna element according to the present invention.
Figure 17:
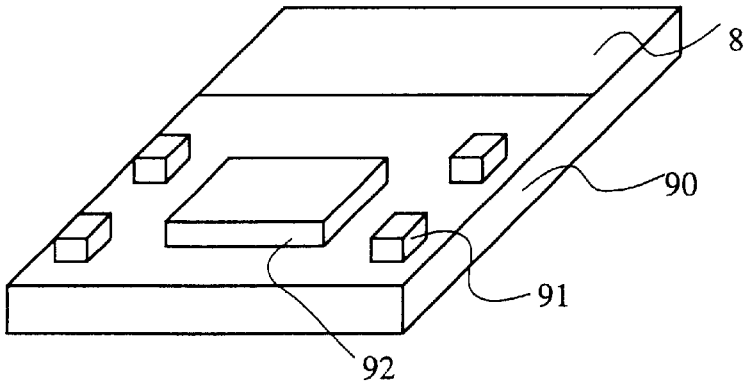
FIG. 17 is a perspective view of a modification of the telecommunication device having the antenna element mounted thereon according to the present invention.

FIGS. 15 through 17 shows modifications of the antenna element according to the present invention. The antenna element 8 shown in FIG. 15 is constructed by forming the radiation electrode 20 shown in FIG. 1 on the dielectric hexahedron substrate 10 and laminating a dielectric hexahedron substrate 10' thereon, in which the radiation electrode 20 is buried in the two dielectric substrates 10, 10'. Burying the radiation electrode in the dielectrics in such a manner allows the electrical length of the radiation electrode to be shortened, so that the antenna can be miniaturized.

The antenna element 9 shown in FIG. 16 comprises an antenna element 9' and an antenna element 9" overlaid one on another in a multi-layered board with the directions of main polarization thereof being perpendicular to one another, the antenna element 9' comprising a first half 30*g* and a second half 40*g* of a radiation electrode 20*g* symmetrically provided on a surface of a dielectric hexahedron substrate 10 g with the same direction of main polarization, and the antenna element 9" comprising a first half 30*g'* and a second half 40*g'* of a radiation electrode 20*g'* symmetrically provided on a surface of a similar substrate 10*g'* with the same direction of main polarization. Arrows shown in FIGS. 16A and 16B indicate the respective directions of main polarization of the antenna element 9', 9". FIG. 16C, which is a superimposing of these drawings, is a perspective view. Since the antenna element 9 has the directions of main polarization perpendicular to one another, it can efficiently receives both the vertical polarization and the horizontal polarization, so that communication can be accomplished efficiently regardless of the direction of the device used. Here, the two antenna elements 9' and 9" may be arranged side-by-side.

FIG. 17 shows an antenna element (for example, the antenna element 8 shown in FIG. 15) integrated into a multi-layered ceramic substrate 90. The multi-layered ceramic substrate 90 constitutes a module substrate and has a chip component 91, such as a bypass capacitor, an RF-IC 92 and the like connected thereto, in which a balun and a filter can be made of a multi-layered conductor. Since the multi-layered ceramic substrate 90 and the antenna element 87 can be fabricated collectively, manufacturing cost can be reduced and the positional precision of the antenna is enhanced, so that the variation in frequency due to the variation in mounting can be reduced.

Experiment 1

Figure 18:
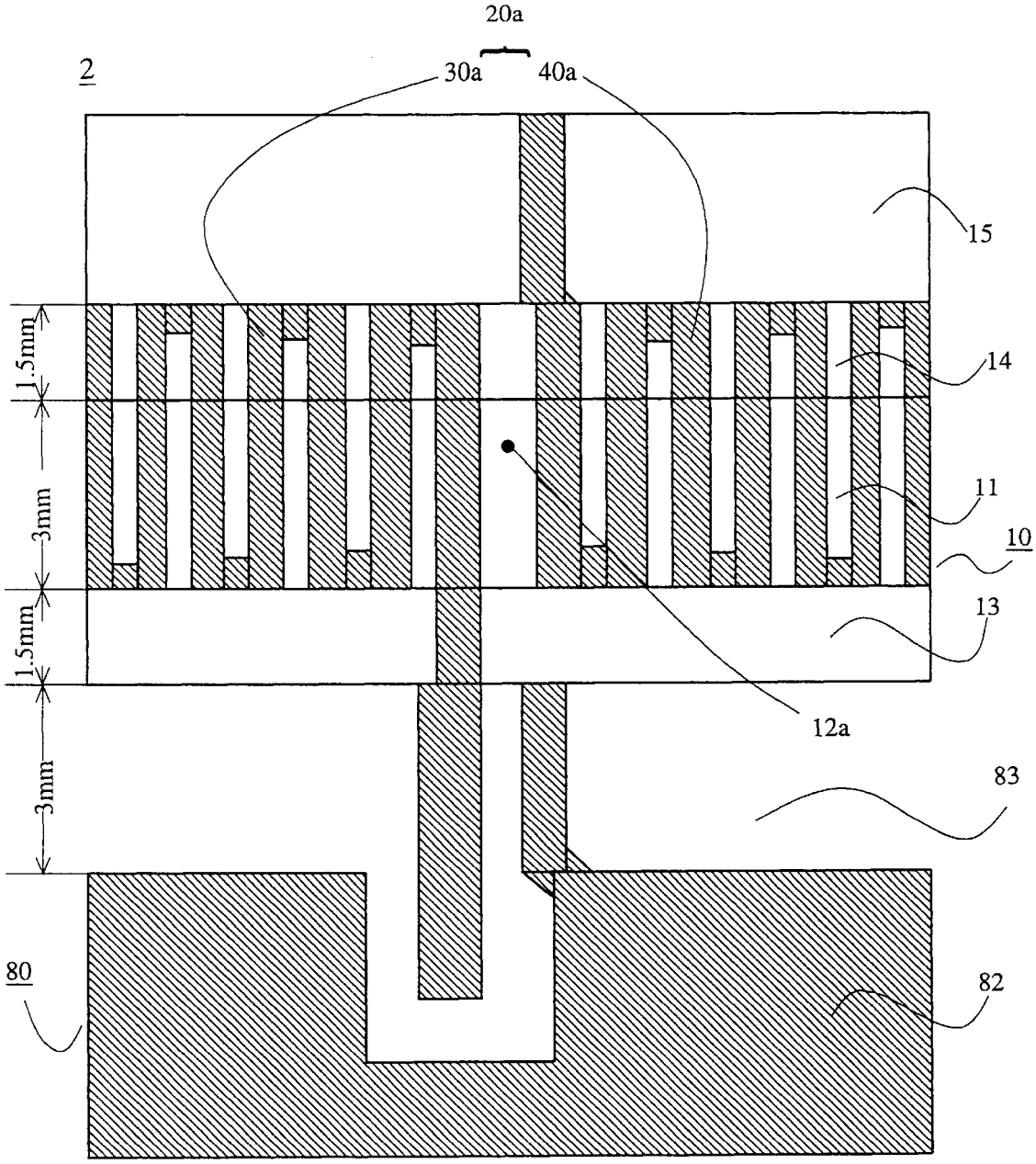
FIG. 18 is a developed view of a conductor portion of the antenna element used in EXPERIMENT 1.

The antenna element 2 shown in FIG. 3 was fabricated and the reflection loss and the voltage standing wave ratio (VSWR) thereof was measured. Using a dielectric having a dielectric constant .epsilon.r of 40, and tan .delta. of 0.0002, a hexahedron substrate 10 of 3.0 mm wide, 13.4 mm long, and 1.5 mm thick was prepared. The halves 30*a*, 40*a* of the meandering radiation electrode 20*a* were provided on the top surface 11 and the rear surface 14 so that the respective halves have a length of a quarter of the radiation wavelength. Here again, reference numerals 13 and 15 denote the front surface and the bottom surface of the substrate 10, respectively. The widths of the respective conductors were, from the outer side toward the center, 0.40 mm, 0.45 mm, 0.50 mm, 0.55 mm, 0.60 mm, 0.65 mm, and 0.70 mm, and the heights (vertical widths in the drawing) of the folded portions were, from the outer side toward the center, 0.40 mm, 0.45 mm, 0.50 mm, 0.55 mm, 0.60 mm, and 0.65 mm. The gap width between the conductors was 0.4 mm, and the center interval between the halves of the radiation electrode was 0.9 mm. FIG. 18 is a developed view of only conductors including the radiation electrode 20*a* of the antenna element, the ground conductor 82 of the printed wiring board 80, and conductors and leads for connecting them. In FIG. 18, the bottom surface 15, the rear surface 14, the top surface 11, the front surface 13 of the dielectric substrate 10 of the antenna element, the printed wiring board 80, the area 83 having no ground conductor, and the ground conductor 82 are shown in this order from top to bottom. The antenna element 2 was mounted on the printed wiring board 80 in such a manner that it is 3 mm distant from the exposed ground conductor 82, the rear surface 14 is located at the end 81 of the substrate, and the bottom surface 15 is mounted on the area of the board 80 having no ground conductor (This mount condition is the same as that shown in FIG. 9). The frequency characteristic was measured for cases where the meandering radiation electrode 20*a* is rotationally symmetrical with respect to the point 12*a*, and where it is linearly symmetrical with respect to a cutting plane passing through the point 12*a*.

Figure 19:
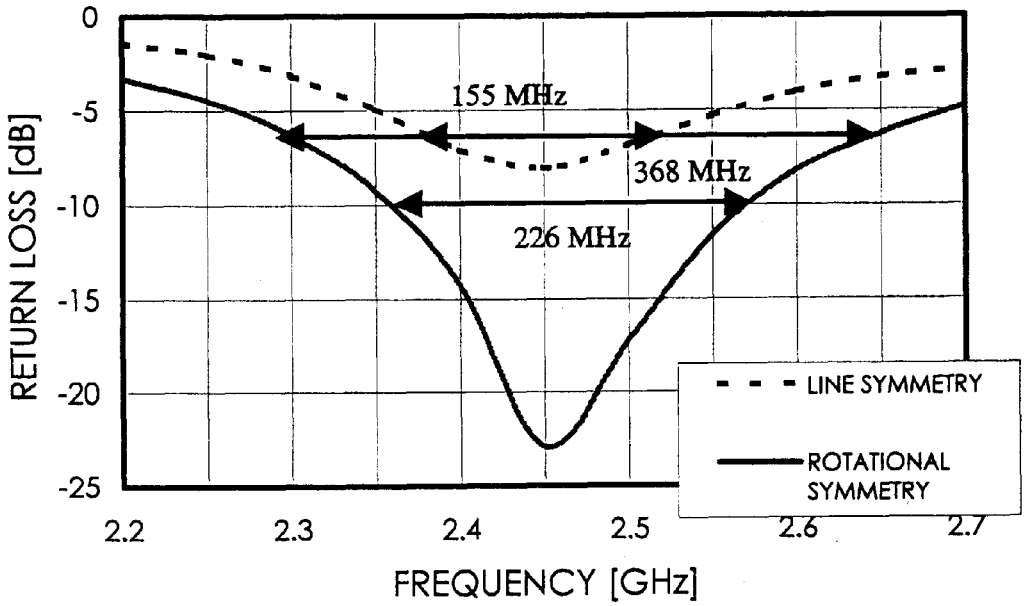
FIG. 19 is a graph showing a relationship between a reflection loss (dB) and a frequency (GHz) of the antenna element used in EXPERIMENT 1.
Figure 20:
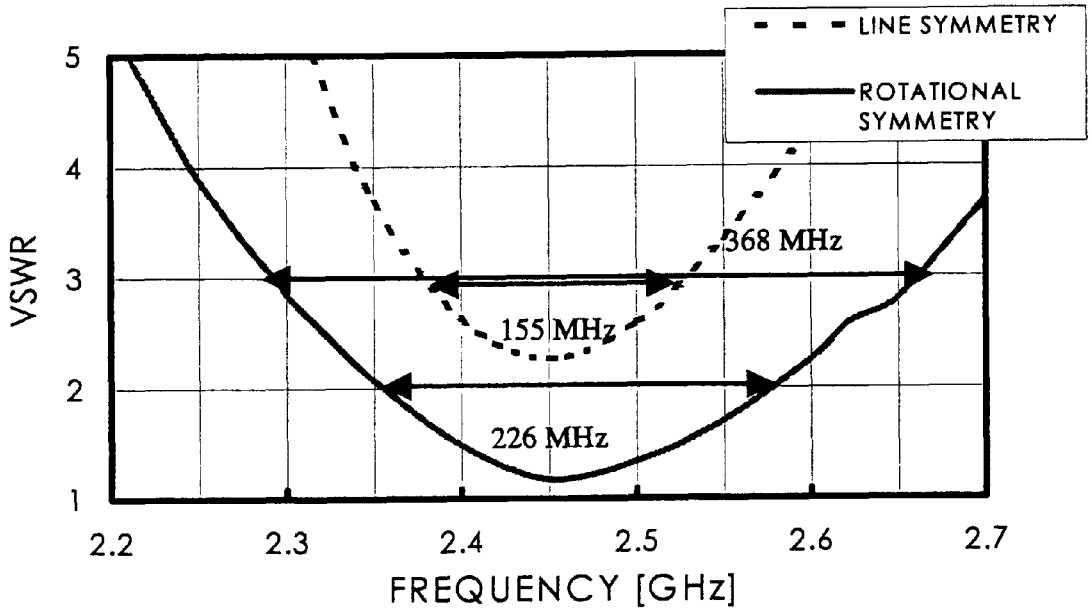
FIG. 20 is a graph showing a relationship between a voltage standing wave ratio (VSWR) and a frequency (GHz) of the antenna element used in EXPERIMENT 1.

FIG. 19 shows a frequency characteristic of the reflection loss, and FIG. 20 shows a frequency characteristic of the voltage standing wave ratio (VSWR). As is apparent from the graphs, in the vicinity of the frequency of 2.44 GHz, the antenna element according to the present invention had a frequency bandwidth equal to or wider than 155 MHz, within which the reflection loss is equal to or less than −6 dB (VSRW is equal to or less than 3%), and in the case of a rotationally-symmetrical quarter-wave radiation conductor, the bandwidth was further widened to become 368 MHz. In addition, the bandwidth within which the reflection loss is equal to or less than −9.54 dB (VSWR is equal to or less than 2%) was 226 MHz.

Experiment 2

Figure 21:
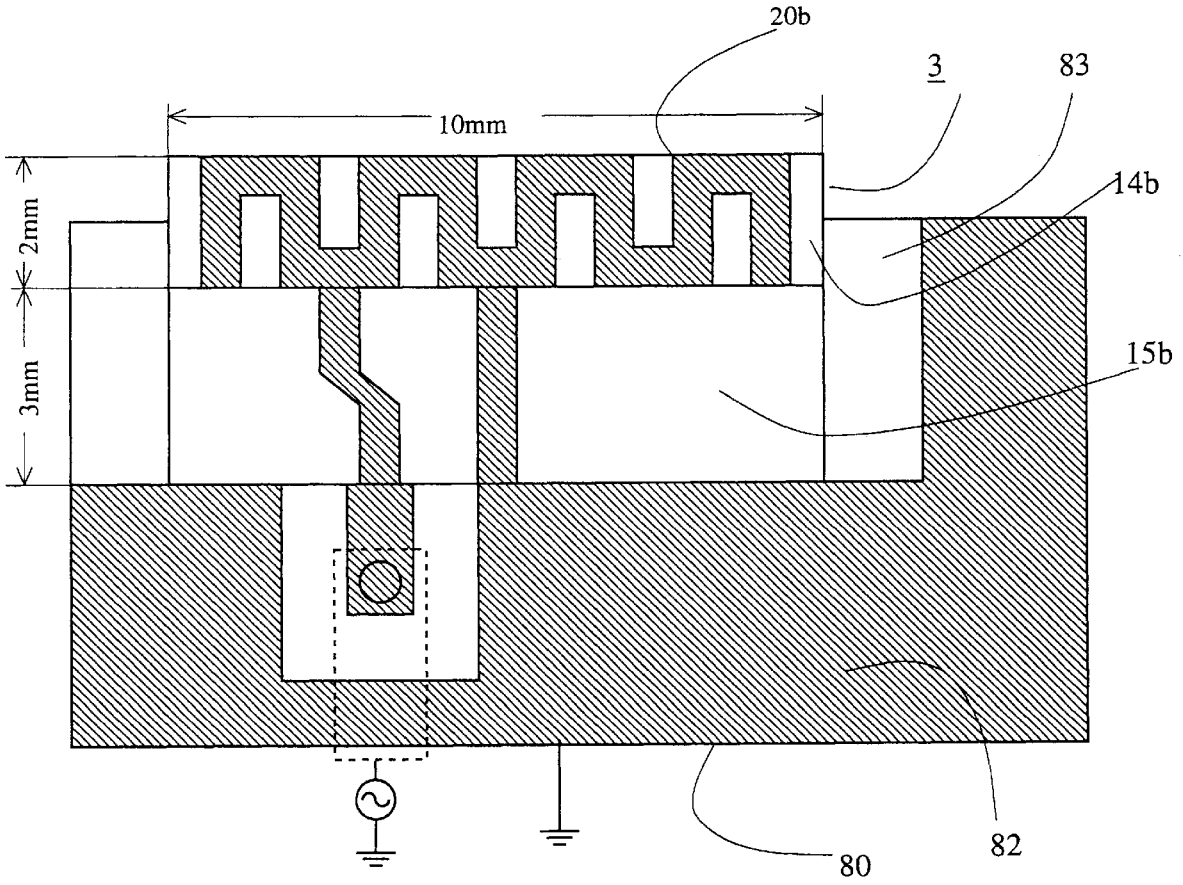
FIG. 21 is a developed view of the conductor portion of the antenna element used in EXPERIMENT 2.

The antenna element 3 shown in FIG. 4 was fabricated and the voltage standing wave ratio (VSWR) thereof was measured. Using a dielectric having a dielectric constant $\epsilon r$ of 40, and tan $\delta$ of 0.0002, a hexahedron substrate of 3.0 mm wide, 10 mm long, and 2 mm thick was prepared. FIG. 21 is a developed view of only conductors including the antenna element 20*b*, the ground conductor 82 of the printed wiring board 80, and conductors and leads for connecting them. In this drawing, the rear surface 14*b* and the bottom surface 15*b* of the dielectric substrate 10*b*, and the ground conductor area 82 of the printed wiring board 80 are shown in this order from top to bottom. The both halves of the radiation electrode 20*b* were meandering quarter-wave antennas. The width of the conductor of the radiation electrode was 0.60 mm, and the gap width between the conductors was 0.60 mm. The antenna element 2 was mounted on the printed wiring board 80 in such a manner that the front surface of the substrate is brought into contact with the exposed ground conductor 82.

Figure 22:
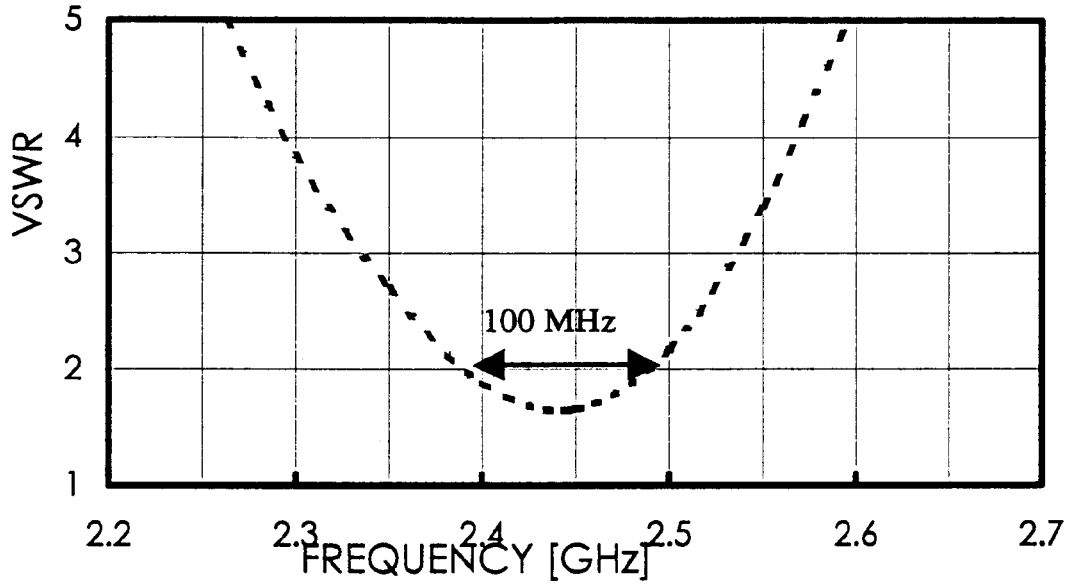
FIG. 22 is a graph showing a relationship between a voltage standing wave ratio and a frequency (GHz) of the antenna element used in EXPERIMENT 2.

FIG. 22 shows a frequency characteristic of the voltage standing wave ratio (VSWR). As is apparent from the graph, in the vicinity of the frequency of 2.44 GHz, the antenna element according to the present invention had a frequency bandwidth equal to or wider than 100 MHz, within which the VSRW is equal to or less than 2%. The relative bandwidth (bandwidth/center frequency) thereof was 4.1%. From the above description, it is apparent that the antenna element according to the present invention can provide a good characteristic even when it is in contact with the ground conductor of the printed wiring board and a high performance within a saved space.

As described above in detail, the antenna element according to the present invention having the radiation conductor symmetrically disposed is compact, provides a good matching, can enhances the radiation efficiency, and allows the bandwidth to be widened.

What is claimed is:

1. An antenna element comprising:

a dielectric substrate, a radiation electrode of an electric conductor formed mainly on a surface of the dielectric substrate, the radiation electrode having a first and a second halves, the first and the second halves being substantially symmetric in form to one another with respect to a center of the radiation electrode, and radiating with the same direction of main polarization of radiation emitted from the radiation electrode, the first half having a first open end at its outer end, another end at a distance of a quarter radiation wavelength along the radiation electrode from the first open end, and a first connection terminal between the first open end and the other end of the first half, the second half having a second open end at its outer end and a second connection terminal at a distance of a quarter radiation wavelength along the radiation electrode from the second open end, the second connection terminal being at a distance from the first connection terminal on the radiation electrode, a power supply conductor formed on the dielectric substrate and connected to the first connection terminal at one end of the power supply conductor and having at the other end of the power supply conductor a terminal for connecting to a high frequency signal source, and a ground conductor formed on the dielectric substrate and connected to the second connection terminal at one end of the ground conductor and having at the other end of the ground conductor a terminal for connecting to a ground, wherein a total conductor length of a portion of the first half between the first open end and the first connection terminal, and the power supply conductor is so different from a total conductor length of a portion of the second half, between the second open end and the second connection terminal, and the ground conductor that the total impedance of the power supply conductor and the portion of the first half between the first open end of the first half and the terminal of the power supply conductor at the other end for connecting to a high frequency signal source and the internal impedance of the high frequency signal source substantially match, in total impedance, the ground conductor and the portion of the second half between the second open end of the second half and the terminal of the ground conductor at the other end for connecting to a ground.

2. An antenna element as set forth in claim 1, wherein the first and the second halves of the radiation electrode connect capacitively to a ground at the first and at the second open ends, respectively.

3. An antenna element as set forth in claim 2, further comprising ground electrodes, formed adjacent to the first and the second open ends on the dielectric substrate, for connecting a ground, each of the ground electrodes connecting capacitively to the first and the second halves of the radiation electrode at the first and at the second open ends, respectively.

4. An antenna element as set forth in claim 3, wherein the radiation electrode is in a meandering form.

5. An antenna element as set forth in claim 1, wherein the electric conductor forming the radiation electrode discontinues between the other end of the first half and the second connection terminal and is divided into the first and the second halves, and the first connection terminal is positioned at the other end of the first half.

6. An antenna element as set forth in claim 5, wherein the radiation electrode is in a meandering form.

7. An antenna element as set forth in claim 5, wherein the electric conductor width of each of the first and the second halves of the radiation electrode is narrowing from the center toward each of the open ends and the distance between the electric conductors of each of the first and the second halves is increasing from the center toward each of the open ends.

8. An antenna element as set forth in claim 5, wherein the ground conductor has an impedance adjustment conductor on a surface of the dielectric substrate.

9. An antenna element as set forth in claim 1, wherein the electric conductor forming the radiation electrode continues at the other end of the first half from the first half to the second half and has the second connection terminal at the other end of the first half.

10. An antenna element as set forth in claim 9, wherein the radiation electrode is in a meandering form.

11. An antenna element as set forth in claim 9, wherein the electric conductor width of each of the first and the second halves of the radiation electrode is narrowing from the center toward each of the open ends and the distance between the electric conductors of each of the first and the second halves is increasing from the center toward each of the open ends.

12. An antenna element as set forth in claim 9, wherein the ground conductor has an impedance adjustment conductor on a surface of the dielectric substrate.

13. An antenna element as set forth in claim 1, further comprising another dielectric substrate formed on the surface of the dielectric substrate on which the radiation electrode is formed.

14. The antenna element as set forth in claim 1, wherein said portion of the first half has a length less than that of said portion of the second half.

15. A telecommunication device comprising:

a printed wiring board having a ground area of the board with a ground conductor, a ground-free area of the board without a ground conductor and a high frequency signal lead, and an antenna element, the antenna element comprising:

a dielectric substrate, a radiation electrode of an electric conductor formed mainly on a surface of the dielectric substrate, the radiation electrode having a first and a second halves, the first and the second halves being substantially symmetric in form to one another with respect to a center of the radiation electrode, and radiating with the same direction of main polarization of radiation emitted from the radiation electrode, the first half having a first open end at its outer end, another end at a distance of a quarter radiation wavelength along the radiation electrode from the first open end, and a first connection terminal between the first open end and the other end of the first half, the second half having a second open end at its outer end and a second connection terminal at a distance of a quarter radiation wavelength along the radiation electrode from the second open end, the second connection terminal being at a distance from the first connection terminal on the radiation electrode, a power supply conductor formed on the dielectric substrate and connected to the first connection terminal at one end of the power supply conductor and having at the other end of the power supply conductor a terminal connected to the high frequency signal lead on the printed wiring board, and a ground conductor formed on the dielectric substrate and connected to the second connection terminal at one end of the ground conductor and having at the other end of the ground conductor a terminal connected to a ground on the printed wiring board, wherein a total conductor length of a portion of the first half, between the first open end and the first connection terminal, and the power supply conductor is so different from a total conductor length of a portion of the second half between the second open end and the second connection terminal and the ground conductor that the total impedance of the power supply conductor and the portion of the first half between the first open end of the first half and the terminal, at the other end of the power supply conductor, connected to the high frequency signal lead and the impedance of the high frequency signal source substantially match, in total impedance, the ground conductor and the portion of the second half between the second open end of the second half and the terminal, at the other end of the ground conductor, connected to the ground on the printed wiring board, wherein the antenna element is mounted on the ground-free area of the board so that a dielectric substrate surface other than the dielectric substrate surface on which the radiation electrode is formed faces the ground-free area.

16. A telecommunication device as set forth in claim 15, wherein the printed wiring board has the ground-free area of the board between the ground area of the board and a side edge of the board and the antenna element is mounted on the ground-free area of the board so that the dielectric substrate surface having the radiation electrode is adjacent to the side edge of the board and a dielectric substrate surface other than the dielectric substrate surface having the radiation electrode faces the ground-free area of the board.

17. A telecommunication device as set forth in claim 16, wherein the antenna element further comprises ground electrodes, formed adjacent to the first and the second open ends on the dielectric substrate, connected to the ground conductor on the printed wiring board, each of the ground electrodes connecting capacitively to the first and the second halves at the first and the second open ends, respectively.

18. A telecommunication device as set forth in claim 17, wherein the radiation electrode is in a meandering form.

19. A telecommunication device as set forth in claim 15, wherein the electric conductor forming the radiation electrode discontinues between the other end of the first half and the second connection terminal and is divided into the first and the second halves, and the first connection terminal is positioned at the other end of the first half.

20. A telecommunication device as set forth in claim 19, wherein the electric conductor width of each of the first and the second halves of the radiation electrode is narrowing from the center toward each of the open ends and the distance between the electric conductors of each of the first and the second halves is increasing from the center toward each of the open ends.

21. A telecommunication device as set forth in claim 19, wherein the ground conductor has an impedance adjustment conductor on a surface of the dielectric substrate.

22. A telecommunication device as set forth in claim 15, wherein the electric conductor forming the radiation electrode continues at the other end of the first half from the first half to the second half and has the second connection terminal at the other end of the first half.

23. A telecommunication device as set forth in claim 22, wherein the electric conductor width of each of the first and the second halves of the radiation electrode is narrowing from the center toward each of the open ends and the distance between the electric conductors of each of the first and the second halves is increasing from the center toward each of the open ends.

24. A telecommunication device as set forth in claim 22, wherein the ground conductor has an impedance adjustment conductor on a surface of the dielectric substrate.

25. The antenna element as set forth in claim 15, wherein said portion of the first half has a length less than that of said portion of the second half.

* * * * *